US009236027B2

(12) United States Patent
Ishida

(10) Patent No.: US 9,236,027 B2
(45) Date of Patent: Jan. 12, 2016

(54) DISPLAY SYSTEM AND COMPUTER-READABLE MEDIUM

(71) Applicant: Hiroshi Ishida, Osaka (JP)

(72) Inventor: Hiroshi Ishida, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 137 days.

(21) Appl. No.: 13/708,623

(22) Filed: Dec. 7, 2012

(65) Prior Publication Data

US 2013/0147860 A1 Jun. 13, 2013

(30) Foreign Application Priority Data

Dec. 9, 2011 (JP) ..... 2011-270500
Dec. 9, 2011 (JP) ..... 2011-270502

(51) Int. Cl.
*G09G 5/10* (2006.01)
*G09G 3/20* (2006.01)

(52) U.S. Cl.
CPC .. *G09G 5/10* (2013.01); *G09G 3/20* (2013.01); *G09G 2320/0285* (2013.01); *G09G 2320/0693* (2013.01); *G09G 2360/147* (2013.01)

(58) Field of Classification Search
CPC ..... G09G 5/10; G09G 3/20; G09G 2360/147; G09G 2320/0693; G09G 2320/0285
USPC ..... 345/589–690
See application file for complete search history.

(56) References Cited

U.S. PATENT DOCUMENTS

| | | | | |
|---|---|---|---|---|
| 2009/0109293 | A1* | 4/2009 | Coley et al. | 348/181 |
| 2009/0167782 | A1* | 7/2009 | Petljanski et al. | 345/601 |
| 2010/0177128 | A1* | 7/2010 | Someya et al. | 345/690 |
| 2011/0298763 | A1* | 12/2011 | Mahajan | 345/207 |
| 2012/0032969 | A1* | 2/2012 | Sugiyama | 345/589 |

FOREIGN PATENT DOCUMENTS

| | | | |
|---|---|---|---|
| JP | 2007-208629 | A | 8/2007 |
| JP | 2008-66830 | A | 3/2008 |
| WO | 2011-509604 | A | 3/2011 |

* cited by examiner

*Primary Examiner* — Charles Hicks
*Assistant Examiner* — Brent D Castiaux
(74) *Attorney, Agent, or Firm* — Birch, Stewart, Kolasch & Birch, LLP

(57) ABSTRACT

The present invention provides a display system capable of efficiently calibrating image content even when the image is displayed and thereby capable of reducing the time and cost required for calibration, and also provides a computer-readable recording medium. The control device thereof processes an image to be displayed on a display section beforehand so as to be usable for calibration. While the image is actually being displayed on the display section, the control device captures an image displayed on the display section using a capturing device at the timing at which a calibration image is displayed, compares the luminance or color in the calibration image with the luminance or color in the image obtained by capturing the calibration image, and creates correction information for correcting an image signal to be output to the display section on the basis of the result of the comparison.

13 Claims, 35 Drawing Sheets

FRAME IMAGE N1

CALIBRATION IMAGE (255, 255, 255)

FRAME IMAGE N2

CALIBRATION IMAGE (170, 170, 170)

FRAME IMAGE N3

CALIBRATION IMAGE (85, 85, 85)

FRAME IMAGE N4

CALIBRATION IMAGE (0,0,0)

DISPLAY SYSTEM AND COMPUTER-READABLE MEDIUM

CROSS-REFERENCE TO RELATED APPLICATION

This non-provisional application claims priority under 35 U.S.C. §119(a) on Patent Applications No. 2011-270500 and No. 2011-270502 filed in Japan on Dec. 9, 2011, the entire contents of which are hereby incorporated by reference.

BACKGROUND

1. Technical Field

The present invention relates to a display system for calibrating luminance unevenness, color unevenness, etc. on the display sections thereof. More particularly, the present invention relates to a display system capable of performing calibration while content is displayed, and to a recording medium on which computer programs for causing a computer to perform calibration are recorded.

2. Description of Related Art

In recent years, a multi-display system (or a multi-vision system) constituting a single large display screen is used in which a plurality of display devices, each having a display section formed of an LCD (Liquid Crystal Display) or a plasma display, are arranged. In such a multi-display system, a large display screen is formed of a plurality of display devices. Hence, it is possible to produce various visual effects; for example, a large image is displayed, different images are displayed on the respective display devices, and the same image is displayed on the display devices disposed symmetrically with each other. With these effects, the multi-display system is used for digital signage to obtain great advertising effects. Furthermore, the multi-display system is sometimes used to relay images effectively or to produce events at an open space, such as an event site or a public facility.

In the multi-display system, a continuous image is sometimes displayed on two display devices adjacent to each other, for example, in the case that one image is displayed on the display sections formed of a plurality of display devices. It is therefore necessary to reduce the differences in color and luminance among the respective display sections. On the other hand, the display properties of the display sections, such as color representation and luminance gradation property, have individual differences. Furthermore, color drift or luminance change occurs because the display properties vary due to temperature change or deterioration with age. For this reason, in the multi-display system, it is necessary to periodically perform calibration to reduce the differences in color and luminance among the display sections formed of the plurality of display devices. Hence, a method capable of performing this kind of calibration simply and efficiently is gaining importance as such multi-display systems become widely used.

As an example of a simple calibration method according to a prior art, a method has been proposed in which a color chart serving as a standard is displayed on a display section and is imaged using a digital camera, and the profile of the display section is obtained from the image signal of the captured image. In the prior art, for the purpose of obtaining an image signal represented in a color space independent of a capturing device, that is, an image signal in the color space inherent in the display section to be subjected to calibration, from the image signal of the captured image, the profile of the capturing device (image sensor) is applied to the image signal and converted so as to eliminate the elements of the color space inherent in the image sensor.

SUMMARY OF THE INVENTION

With the prior art, calibration can be performed using a simple configuration composed of a digital camera, instead of using an expensive colorimeter, for detecting the colors on the display sections formed of the display devices.

However, in the method in which calibration is performed while a specific calibration image, such as a color chart, is displayed, the display of image content, such as a still image or a moving image, being displayed is required to be stopped once. In particular, in the case that the display section of a multi-display system being used as digital signage at all times is subjected to calibration, the reproduction of image content for advertisement must be stopped, whereby the function of the multi-display system serving as digital signage is lost temporarily. On the other hand, it is conceived that calibration is performed in a time zone, such as night time, during which people do not watch the display sections of the multi-display system. In this case, however, the image content is reproduced while the state in which color drift or the like occurs and the quality of the image is deteriorated remains unchanged for a certain period until night time when calibration is performed.

In consideration of these circumstances, the present invention is intended to provide a display system capable of efficiently calibrating image content even when the image content is being reproduced and thereby capable of reducing the time and cost required for the calibration, and to provide a recording medium on which computer programs for causing a computer to perform the calibration are recorded.

In the case of the present invention, images or regions to be used for calibration are included in a plurality of images of content data. Calibration can be performed while the content data is displayed. Since calibration can be performed while the content data is displayed, it is not necessary to stop image display when the calibration is carried out. In particular, in a display system for use in digital signage or the like that is required to output content at all times, luminance or color can be calibrated without losing the function of the digital signage, whereby an excellent effect is obtained.

DESCRIPTION OF THE PREFERRED EMBODIMENT

The present invention will be described below specifically on the basis of the drawings showing the embodiments thereof.

Embodiment 1

Figure 1:
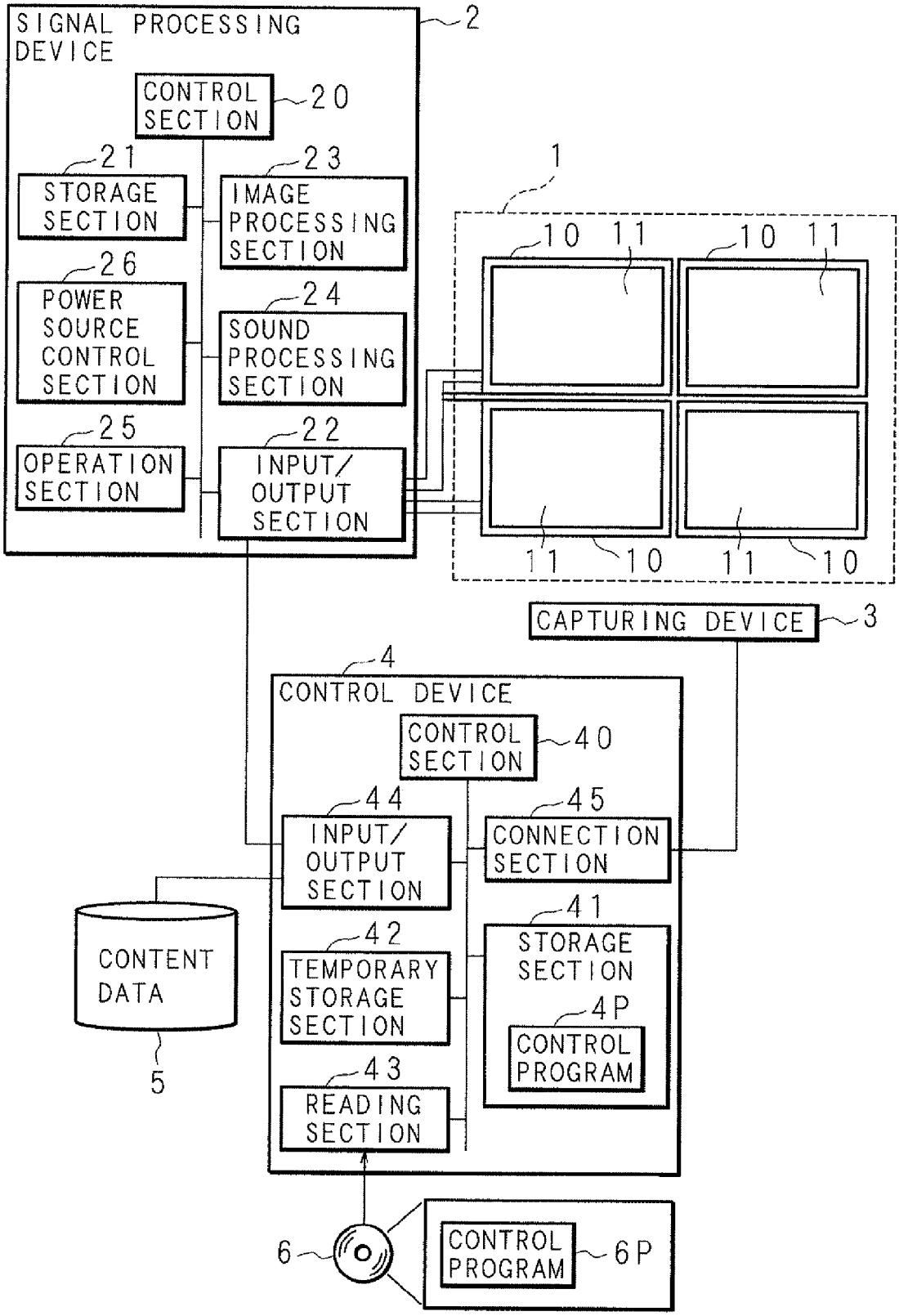
FIG. 1 is a block diagram showing the configuration of a display system according to Embodiment 1.

FIG. 1 is a block diagram showing the configuration of a display system according to Embodiment 1. The display system includes a display section 1 formed of a plurality of display devices 10; a signal processing device 2 for processing image signals to be output to the display devices 10; a capturing device 3 for capturing the display section 1; and a control device 4 for calibrating the luminance or color of images displayed on the group of the display devices 10.

The display system is used as digital signage, and the display section 1 is thus installed in an easily visible location in a city where people gather. The signal processing device 2 is installed in the vicinity of the display section 1, for example, and connected to the respective display devices 10 of the display section 1 via cables conforming to the system described later. The capturing device 3 is installed so as to use the entire area of the display section 1 as a capturing range. For example, the capturing device 3 is mounted on a wall surface, a ceiling, etc. above the front face of the display section 1 serving as digital signage. The control device 4 is connected to both the signal processing device 2 and the capturing device 3. The control device 4 is installed in the vicinity of the display section 1 together with the signal processing device 2, for example. In FIG. 1 and the following descriptions, the group of the display devices 10, the signal processing device 2, the capturing device 3, and the control device 4 are respectively configured so as to be connected by wire. In the present invention, these devices may be configured so that signals are transmitted and received wirelessly.

In the display system configured as described above, the signal processing device 2 generates an image signal from the content data output from the control device 4 and outputs the signals to the respective display devices 10 of the display section 1 to display images. Content to be used in Embodiment 1 is assumed to be a moving image. Alternatively, the content may be stream data multiplexed with sound. Each of these is advertisement content.

In particular, to improve the quality of an image to be displayed on the display section 1 or to maintain the quality of the image, the display system according to Embodiment 1 has a calibration function for specifying the relationship between the luminance or color gradation value of an image indicated by an image signal and the luminance or color gradation value of an image actually indicated on each display device 10 of the display section 1 and for correcting the image signal on the basis of the relationship. In particular, the display system performs correction to decrease the difference in luminance or color among display devices in a multiple display system 10, thereby outputting content with high image quality. The general description of the calibration function achieved by the display system is provided below. Using the capturing device 3, the control device 4 images the display section 1 displaying an image based on content for use in digital signage, compares the luminance or color gradation value of an image to be displayed with the luminance or color gradation value obtained from the captured image, specifies the relationship between the gradation value of the image of the output image signal and the gradation value of the displayed image, calculates a correction value for an image signal to be output according to the obtained relationship, and makes correction. For this purpose, the control device 4 generates content so that a calibration image to be used for calibration is displayed in an image based on content for advertisement, specifies the timing at which the calibration image is displayed on the display section 1, performs a capturing process using the capturing device 3 at the specified timing, obtains the information on the luminance or color in the corresponding region in the captured image, compares the luminance or color with the luminance or color of the image of the output image signal, calculates a correction amount for each display device 10, and makes correction.

The respective components and the processes performed by the respective components will be described below in detail.

The display section 1 uses four display devices 10. The display devices 10 are arranged to be tiled together contiguously to form a multiple display system, for example 2×2 multiple display system. The display section 1 may be configured using a single display device 10, or a multiple display system 10 may be configured using a given number of display devices 10 being arranged in 3×3 or in 2×3 display devices, for example.

The display device 10 is equipped with a panel 11. The panel 11 uses an LCD or a plasma display. The display device 10 displays an image on the panel 11 on the basis of an image signal output from the signal processing device 2 as described later. It may be possible that each display device 10 is equipped with a speaker so that sound is output on the basis of a sound signal output from the signal processing device 2. However, the speaker may be installed separate from the display section 1.

The signal processing device 2 is equipped with a control section 20, a storage section 21, an input/output section 22, an image processing section 23, a sound processing section 24, an operation section 25, and a power source control section 26.

The control section 20 uses a CPU (Central Processing Unit) and controls the respective components on the basis of computer programs not shown.

The storage section 21 is composed of an external storage device, such as a hard disk drive or an SSD (Solid State Drive). The storage section 21 may be composed of a flash memory. In the storage section 21, for example, data in which an image displayed on the display section 1 and sound to be output are multiplexed may be stored, and the information on a correction amount applied to each image signal to be output to each display device 10 may also be stored as described later.

The input/output section 22 is an interface through which image signals and control-use data are input and output among the signal processing device 2, the respective display devices 10, and the control device 4. More specifically, the input/output section 22 has DVI (Digital Visual Interface) and HDMI (High-Definition Multimedia Interface) terminals. By virtue of the interface, the signal processing device 2 performs serial communication with the control device 4 by using the TMDS (Transition Minimized Differential Signaling) system as a predetermined system and outputs image signals to the respective plurality of display devices 10 of the display section 1. Furthermore, the input/output section 22 has a LAN terminal for transmitting and receiving image signals using a communication protocol, such as the TCP (Transmission Control Protocol) or UDP (User Datagram Protocol), and transmits/receives control-use data to/from an external device by communication. The input/output section 22 may receive the data of the image signals from the control device 4 via the LAN terminal. Furthermore, the input/output section 22 may also be configured so as to have USB (Universal Serial Bus) terminals or IEEE 1394 terminals.

The image processing section 23 uses an integrated circuit for image processing and performs predetermined image processing including the correction of luminance, color, color space, etc. and various kinds of filtering processing for an image signal input via the input/output section 22. On the basis of instructions from the control section 20, the image processing section 23 outputs an image signal subjected to the image processing from the input/output section 22 to each display device 10 of the display section 1. At this time, on the basis of the arrangement information on the display devices in the multiple display system 10 obtained by the control section 20, the image processing section 23 outputs an image signal corresponding to each display device 10. The arrangement information is, for example, information in which the display device 10 on the upper left side of the display section 1, as viewed in FIG. 1, is defined as the display device 10 at (0.0) in the 0th row and in the 0th column and the display device 10 on the lower right side is defined as the display device 10 at (1.1) in the 1st row and in the 1st column. The control section 20 may obtain the arrangement information stored beforehand in the storage section 21 or may obtain the arrangement information to be input externally. Furthermore, the image processing section 23 may be implemented in software by the control section 20.

The sound processing section 24 receives a sound signal through the input/output section 22 and performs predetermined processing including correction and filtering processing for the received sound signal. On the basis of an instruction from the control section 20, the sound processing section 24 outputs the processed sound signal to a speaker, not shown, and the speaker outputs sound. The signal processing device 2 is not required to be equipped with the sound processing section 24.

The operation section 25 includes at least a power switch, a selection switch, and a reproduction/stop switch. The power switch, the selection switch, and the reproduction/stop switch of the operation section 25 are formed in the signal processing device 2 so as to be operable by the operator of the display system. The power switch is a switch for turning on and off the power source of the signal processing device 2. The selection switch is a switch for controlling one of the plurality of display devices 10 constituting the display section 1 and is a switch for selecting the plurality of display devices 10 at the same time. The reproduction/stop switch is a switch for the operator to instruct the reproduction/stop operation of content and is a switch for starting/stopping the input of an image signal and a sound signal to the image processing section 23 and the sound processing section 24, that is, a switch for starting/stopping the output of an image signal to the display section 1. Upon detecting which switch was pressed, the operation section 25 gives a notice to the control section 20.

The operation section 25 may be configured so as to be provided for a remote controller that can wirelessly communicate with the signal processing device 2. In this case, the remote controller transmits, to the signal processing device 2, a wireless signal corresponding to each pressed switch of the operation section. The medium of communication for wireless communication may be an infrared ray or an electromagnetic wave. Furthermore, it may be possible that the signal corresponding to each pressed switch of the operation section 25 is transmitted from the control device 4 described later as an operation instruction depending on the operation of the operator and that the signal processing device 2 receives this signal and operates on the basis of the operation instruction.

The power source control section 26 controls the power supplied from an external power supply source (not shown). After receiving the notice that the power switch of the operation section 25 was pressed, the control section 20 supplies power to the power source control section 26 from the outside or shuts off the supply of power. Upon receiving the supply of power, the power source control section 26 supplies power to the entire signal processing device 2. On the other hand, when the supply of power is shut off, the power source control section 26 shuts off the supply of power to the entire signal processing device 2.

Moreover, for example, it may be possible that the signal processing device 2 is equipped with an antenna and a tuner for television broadcasting, receives not only the image signal and the sound signal output from the control device 4 but also a broadcast signal and outputs the image signal and the sound signal based on the broadcast signal to display the image signal and the sound signal on the display section 1.

The capturing device 3 is, for example, composed of a digital camera having an USB terminal and connected to the control device 4 described later via the USB cable. The USB cable is not limitedly used for the connection to the control device 4. The capturing device 3 receives a capturing request signal from the control device 4 via the USB cable and USB terminal. Upon receiving the capturing request signal, the capturing device 3 captures the image of the entire display section 1. The capturing device 3 outputs the image signal of the captured image to the control device 4 via the USB terminal. Settings, such as focus, shutter speed, aperture, white balance, color space, and the file format of the captured image, have been done beforehand so that the capturing device 3 can capture the image of the display section 1 properly. In particular, since capturing is performed while an image based on the data of content, that is a moving image, is displayed on the display section 1, the shutter speed is set so as to be higher than the frame rate of the content.

The control device 4 is composed of a personal computer and is equipped with a control section 40, a storage section 41, a temporary storage section 42, a reading section 43, an input/output section 44, and a connection section 45.

The control section 40 is composed of a CPU and achieves various functions described later on the basis of control programs 4P stored in the storage section 41, thereby achieving the control of the display system and the calibration of the luminance or color in the display section 1 of the display system.

The storage section 41 is composed of an external storage device, such as a hard disk drive or an SSD. The storage section 41 may be composed of a flash memory. In addition to the above-mentioned control programs 4P, information to be referred to by the control section 40 at the time of processing may also be stored beforehand in the storage section 41. Besides, information to be requested by the processing of the control section 40 is also stored in the storage section 41. In particular, calibration information 411 for each content item obtained when the control section 40 performs the processing described later is stored in the storage section 41 so as to be referred to later by the control section 40. Still further, correction information 412 requested for calibration is stored in the storage section 41.

The temporary storage section 42 is composed of a RAM, such as an SRAM (Static Random Access Memory) or a DRAM (Dynamic Random Access Memory). The temporary storage section 42 is used when the control section 40 reads the control programs 4P from the storage section 41. In addition, the temporary storage section 42 temporarily stores information generated by the processing of the control section 40, such as image data being processed and information extracted from image data.

The reading section 43 is composed of a disk drive. The reading section 43 reads information recorded on a recording medium 6, such as a CD (Compact Disc), a DVD (Digital Versatile Disc), a BD (Blue-Ray (registered trade name) Disc), a flash memory, or a flexible disk. Control programs 6P are recorded on the recording medium 6. The control section 40 reads information recorded on the recording medium 6 using the reading section 43 and stores the information in the storage section 41 or the temporary storage section 42. The control programs 4P stored in the storage section 41 may be a duplicate of the control programs 6P read from the recording medium 6.

The recording medium 6 should only be a recording medium 6 configured so as to be separable from the control device 4 and may further be composed of tape, such as magnetic tape or cassette tape; a magnetic disk, such as a hard disk or the above-mentioned flexible disk; an optical disc, such as the above-mentioned CD, DVD or BD; a card, such as a memory card or an optical card; or a semiconductor memory, such as a mask ROM (Read Only Memory), an EEPROM (Erasable Programmable ROM), an EEPROM (registered trade name: Electrically EPPROM) or a flash ROM. Moreover, since the input/output section 44 provided for the control device 4 may have a LAN terminal as described later, the control programs 6P may be downloaded from the outside via a network and can be implemented in the form of a computer data signal embedded in a carrier wave embodied by electrical transmission.

The input/output section 44 is an interface between the control device 4 and the signal processing device 2 and between the control device 4 and an external storage device 5. More specifically, the input/output section 44 has DVI and HDMI terminals and reads the content data from the storage device 5 and transmits an image signal, a sound signal and control-use information to the signal processing device 2 via the terminals. The input/output section 44 may have a LAN terminal and may perform communication with an external device, or may transmit/receive data to/from the signal processing device 2 via the LAN terminal. The input/output section 44 may further be configured so as to have a USB terminal or an IEEE 1394 terminal.

The connection section 45 has a USB terminal, for example, and is connected to the capturing device 3. The terminal of the connection section 45 is not limited to the USB terminal, provided that the control device 4 can be connected to the capturing device 3 and can input/output signals for controlling the capturing operation of the capturing device 3. The control device 4 transmits a capturing request signal to the capturing device 3 via the connection section 45 and receives the image signal of a captured image.

The storage device 5 is composed of a large-capacity HDD, an SSD, or the like to store the content data. The content data stored in the storage device 5 can be read from the control device 4. The storage device 5 may be a recording medium, such as a DVD, and may be configured so that the information thereon can be read by the control device 4. The storage device 5 may be the storage section 41 provided for the control device 4. The content data is content including moving images and sound for advertisement to be displayed on the display section 1 functioning as digital signage.

Figure 2:
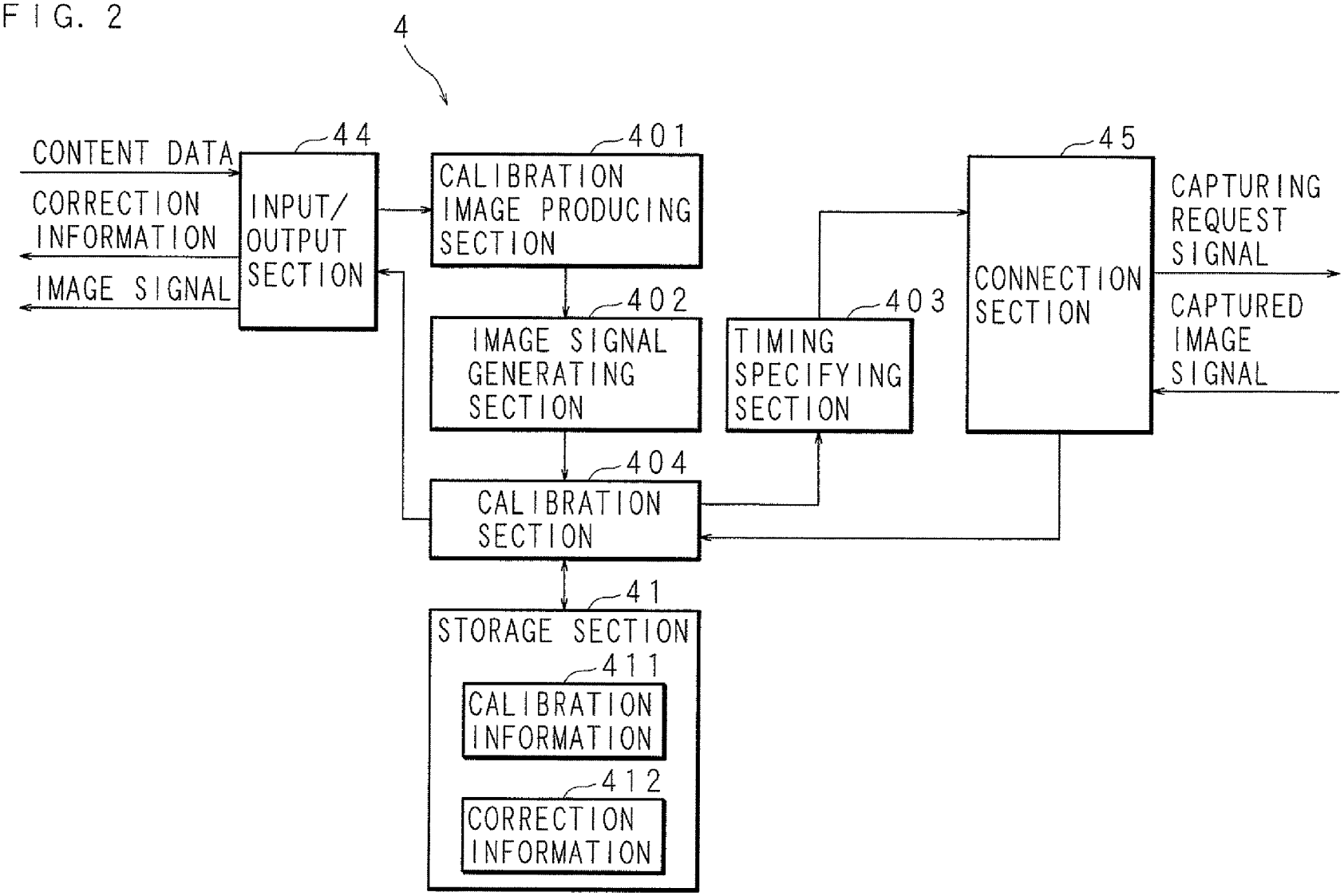
FIG. 2 is a functional block diagram showing the functions achieved by a control device according to Embodiment 1.

FIG. 2 is a functional block diagram showing the functions achieved by the control device 4 according to Embodiment 1. The control section 40 of the control device 4 reads and executes the control programs 4P stored in the storage section 41, thereby functioning as a calibration image producing section 401, an image signal generating section 402, a timing specifying section 403 and a calibration section 404, causing a personal computer to operate as the control device 4 of the display system, and performing various processes described below to carry out calibration. The calibration image producing section 401, the image signal generating section 402, the timing specifying section 403, and the calibration section 404 may be implemented in hardware as an integrated circuit.

The calibration image producing section 401 obtains an image in frame unit from the content data read by the control section 40. The calibration image producing section 401 produces a calibration image formed of pixels having uniform luminance or color for calibrating the luminance or color to be displayed. The calibration image producing section 401 produces a calibration image with respect to a predetermined plurality of luminance or color levels. Uniformity is not required in the entire region as a matter of course, and an image being uniform in luminance or color at a predetermined ratio, such as 80% or more, may be produced. It may be possible that calibration images are produced and stored in the storage section 41 beforehand and selected by the calibration image producing section 401. Information on different color or luminance levels is stored in the storage section 41 beforehand so as to be able to be referred to by the calibration image producing section 401. For example, the calibration image producing section 401 divides luminance into a plurality of levels, such as four levels, 10 levels or 18 levels, from luminance 0 (zero) to the maximum luminance and produces calibration images having the respective luminance levels. More specifically, in the case that the maximum luminance is (255, 255, 255) and the luminance is divided into four levels, the calibration image producing section 401 produces a calibration image including regions respectively having four levels (0, 0, 0), (85, 85, 85), (170, 170, 170), and (255, 255, 255) as RGB values. In addition, the calibration image producing section 401 produces, for example, a calibration image formed of pixels having 18 different colors. For example, the calibration image producing section 401 produces calibration images formed of pixels having RGB values of red (255, 0, 0), orange (255, 102, 0), yellow (255, 255, 0), green (0, 255, 0), blue (0, 0, 255), purple (153, 0, 153), . . . .

The calibration image producing section 401 stores the calibration information 411 including the frame number for specifying the frame image on the basis of which a calibration image is produced and information indicating the luminance or color of the produced calibration image in the storage section 41. At this time, in the case that a plurality of frame images from which the same calibration image, that is, a calibration image having the same luminance or color, is judged to be producible are present, the frame number of the frame image ahead of or behind the frame image that was judged first that the calibration image was able to be produced is stored.

The image signal generating section 402 inserts the produced calibration image between the frame images based on the content data read by the control section 40 or replaces either one of the frame images with the calibration image and outputs the obtained image signal as a new image signal from the input/output section 44 to the signal processing device 2. More specifically, on the basis of the calibration information 411 stored in the storage section 41, the image signal generating section 402 outputs the calibration image having the corresponding luminance or color to the stored frame number.

When calibration is actually performed on the basis of the stored calibration information 411, in the case that the image signal generating section 402 starts outputting an image signal, the timing specifying section 403 calculates the time (the time elapsed from the start of image display) when the calibration image is displayed on the display section 1. The timing specifying section 403 can calculate the display time as described below, for example.

$$\text{Display time} = \text{frame number} \times \text{frame rate}$$

The frame number is the number ahead of or behind the frame number specified by the calibration information 411 stored in the storage section 41. After this, when the image signal is output from the control section 40 to the signal processing device 2, the timing specifying section 403 outputs, to the capturing device 3, a signal indicating that the image signal has been output, activates the capturing device 3, and then outputs a capturing request signal at the time point at which capturing should be performed on the basis of the calculated time. Hence, the timing specifying section 403 controls the timing of capturing so that capturing is performed using the capturing device 3 when the calibration image is displayed.

With respect to the control of the synchronization between the timing at which the calibration image is displayed on the display section 1 and the capturing timing of the capturing device 3, the timing specifying section 403 measures a delay time relating to the transmission delay and measurement (capturing process) delay in the input/output section 44 and the connection section 45 and in the input/output section 22 of the signal processing device 2 and then outputs a capturing request signal in consideration of the delay time. Furthermore, the timing specifying section 403 may be configured so as to output the capturing request signal without considering the delay time by using the capturing device 3 that can use a shutter having a very short delay time (for example, 1/10 or less of the frame rate) in comparison with the frame rate of the content data.

When the output of the content data to be used for calibration is started by the processing of the control section 40, the calibration section 404 performs a calibration process on the basis of the stored calibration information 411. When the output of the content data is started, the calibration section 404 receives the image signal of the image captured under the control of the timing specifying section 403 through the connection section 45. The calibration section 404 compares the captured image based on the received image signal with the calibration image corresponding thereto, specifies the difference in luminance or color, obtains a correction amount, and corrects the image signal. When comparing the captured image with the calibration image, the calibration section 404 divides the image into block images on the basis of the arrangement information on the display devices in the multiple display system 10, makes comparison for each block image, specifies a difference for each display device 10, and obtains a correction amount. It may be possible that the control section 40 obtains the arrangement information from the signal processing device 2 beforehand and stores the arrangement information in the storage section 41, or the calibration section 404 obtains the arrangement information from the signal processing device 2.

Figure 3:
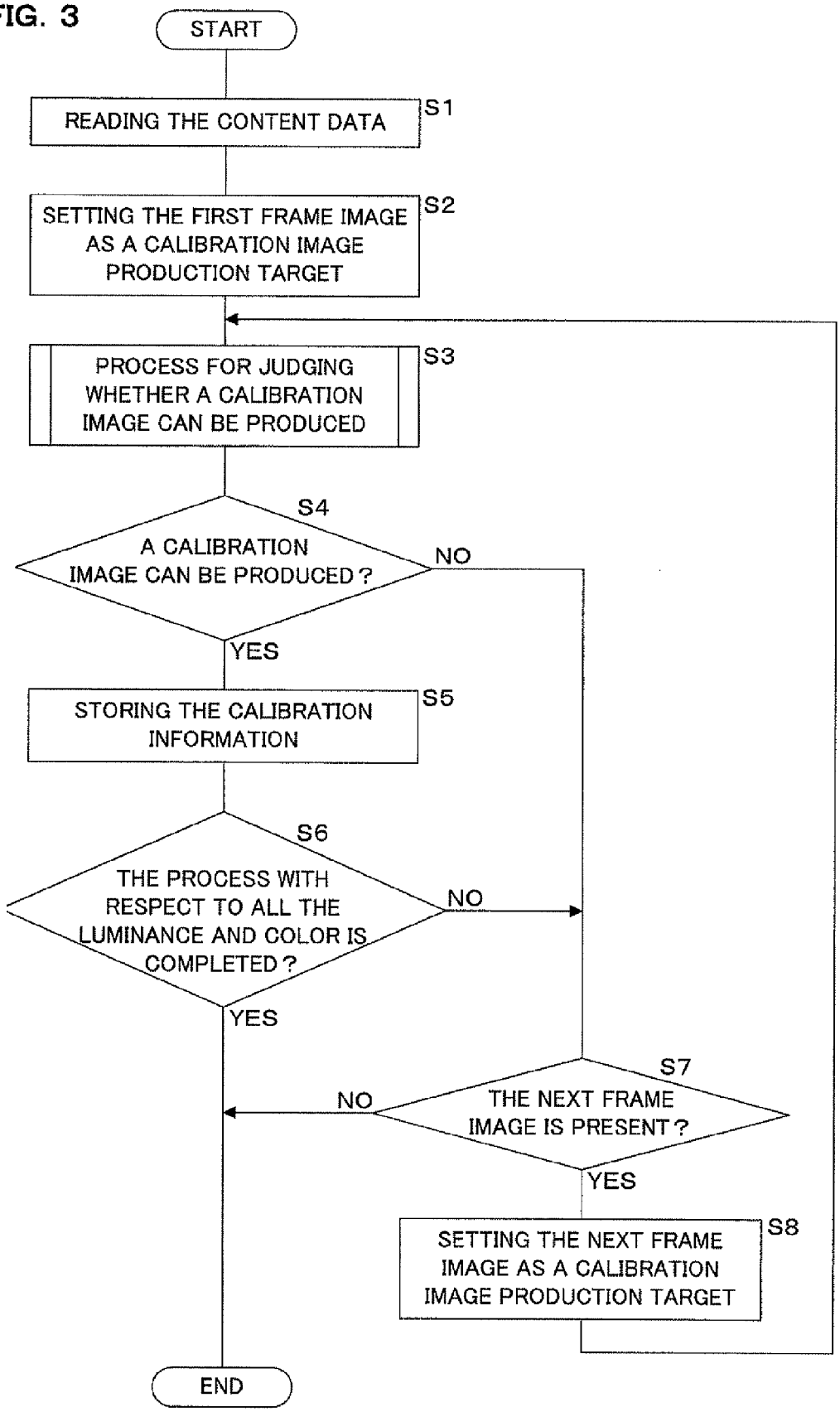
FIG. 3 is a flow chart showing an example of a processing procedure performed by the calibration image producing section of the control device according to Embodiment 1.

In the display system configured as described above, a procedure in which the luminance or color in the display section 1 is calibrated will be described in detail sequentially. FIG. 3 is a flow chart showing an example of a processing procedure performed by the calibration image producing section 401 of the control device 4 according to Embodiment 1. By the calibration image producing section 401, the control section 40 of the control device 4 performs respective processes beforehand according to the following procedure before performing calibration using the content data read from the storage device 5.

The control section 40 reads the content data from the storage device 5 through the input/output section 44 (at step S1), and sets the first frame image (frame number 0 (zero)) as a calibration image production target (at step S2). More specifically, the control section 40 assigns 0 (zero) to the frame number of the frame image serving as the calibration image production target.

The control section 40 performs a process for judging whether a calibration image can be produced actually from the frame image serving as the tentative calibration image production target (at step S3). As the result of the process, the control section 40 judges whether the calibration image can be produced (at step S4). In the case that the control section 40 judges that the calibration image can be produced (YES at S4), the control section 40 stores the calibration information 411 including the information on the frame number of the frame image from which the calibration image can be produced and on the luminance or color of the calibration image in the storage section 41 (at step S5). The control section 40 then judges whether the process with respect to all the luminance and color to be calibrated is completed (at step S6). In the case that the control section 40 judges that the process with respect to all the luminance and color to be calibrated is completed (YES at S6), the control section 40 ends the process.

In the case that the control section 40 judges at step S4 that no calibration image can be produced (NO at S4) and in the case that the control section 40 judges at step S6 that the process with respect to all the luminance and color to be calibrated is not completed (NO at S6), the control section 40 judges whether the next frame image is present (at step S7). In the case that the control section 40 judges that the next frame image is present (YES at S7), the control section 40 sets the next frame image as a calibration image production target (at step S8) and returns the process to step S3. In the case that the control section 40 judges that the next frame image is not present (NO at step S7), the control section 40 ends the process.

Figure 4:
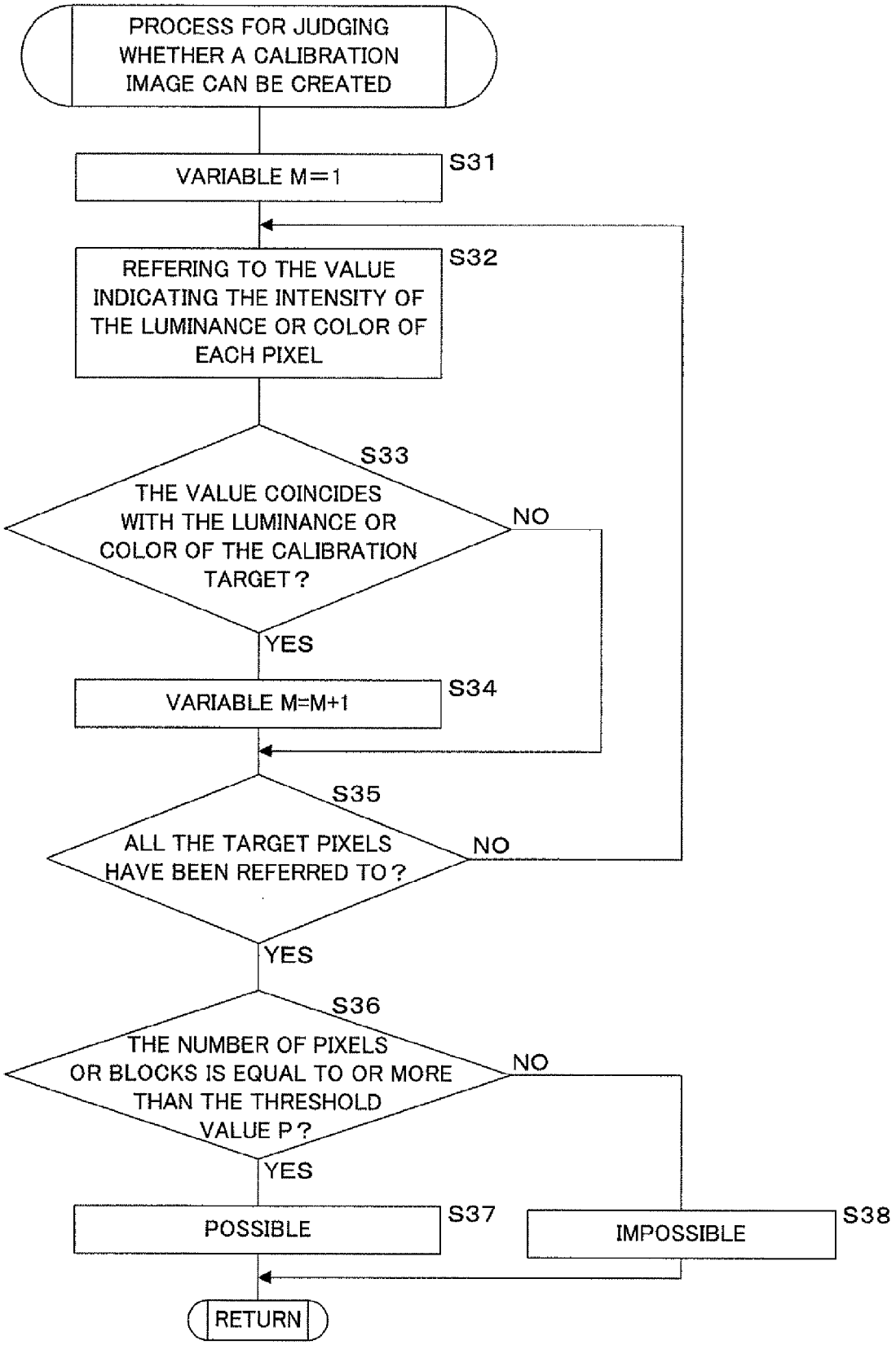
FIG. 4 is a flow chart showing an example of a judging process as to whether a calibration image can be produced at step S3 shown in FIG. 3.

FIG. 4 is a flow chart showing an example of a judging process as to whether the calibration image can be produced at step S3 shown in FIG. 3. The control section 40 performs the following process using the calibration image producing section 401.

The control section 40 assigns 1 to a counting variable M (at step S31). The control section 40 sequentially scans the pixels of the frame image and sequentially refers to the value indicating the intensity of the luminance or color of each pixel using the function of the calibration image producing section 401 (at step S32), and then judges whether the value coincides with the luminance or color of the calibration target within an allowable range (at step S33).

More specifically, in the case that the colors of the pixels of the frame image are represented by gradation values indicating the intensity of RGB (R: red, G: green, B: blue), when it is assumed that the RGB values of the calibration target are (Rc, Gc, Bc), the control section 40 judges that the following three expressions are satisfied with respect to the color of each pixel using the function of the calibration image producing section 401.

$$Rc-\delta_R \leq R \leq Rc+\delta_R$$

$$Gc-\delta_G \leq G \leq Gc+\delta_G$$

$$Bc-\delta_B \leq B \leq Bc+\delta_B$$

At this time, it is assumed that the guide values of $\delta_R$, $\delta_G$ and $\delta_B$ are respectively approximately 1/32 of the maximum values of the RGB values. For example, in the case that the RGB values are respectively represented by an 8-bit digital signal, the values of $\delta_R$, $\delta_G$ and $\delta_B$ become "8" because the RGB values are in the range of 0 to 255. The values of $\delta_R$, $\delta_G$ and $\delta_B$ should be set appropriately; for example, they should be set to small values in the case that luminance steps are set minutely.

Furthermore, at step S32, in order that calibration image production is not performed on the basis of an image having many edges, instead of referring to all the pixels in each frame image one by one and making a judgment as to whether the luminance or color of each pixel coincides with specific luminance or color, the calibration image producing section 401 may refer to each block formed of a plurality of pixels, such as 3×3 pixels. At this time, the average value, the median value, or the like may be calculated and used as the luminance or color of each block. Moreover, for the purpose of speeding up the process, instead of referring to all the pixels of each frame image, the calibration image producing section 401 may refer to typical pixels, for example, one of every four pixels, by performing a thinning process. Still further, the calibration image producing section 401 may divide the frame image into blocks, each block being formed of 3×3 pixels, for example, calculates the average value or the like of the luminance or color of each block so that the pixels are thinned further and referred to.

In the case that the control section 40 judges that coincidence is obtained at step S33 (YES at S33), the control section 40 adds 1 to the variable M (at step S34) and judges whether all the target pixels have been referred to (at step S35). In the case that the control section 40 judges that coincidence is not obtained at step S33 (NO at S33), the control section 40 advances the process to step S35.

In the case that the control section 40 judges that all the target pixels have not been referred to (NO at S35), the control section 40 returns the process to step S32 and refers to the luminance or color of the next pixel.

In the case that the control section 40 judges that all the pixels have been referred to (YES at S35), the control section 40 judges whether the number of pixels or blocks having luminance or color being coincident with that for calibration is equal to or more than a predetermined threshold value p (at step S36). The threshold value p is a ratio, for example, 50%, or the number of pixels. In the case that the control section 40 judges that the number is equal to or more than the predetermined threshold value p (YES at S36), the control section 40 judges that calibration image production is possible (at step S37), and the control section 40 returns the process to step S34 of the flow chart shown in FIG. 3.

In the case that the control section 40 extracts a region in which a predetermined number or more of pixels having uniform luminance or color are present continuously in the horizontal direction and in the vertical direction, that is, a uniform region of a predetermined size or more, the control section 40 may judge that the number is equal to or more than the predetermined threshold value p and may judge that the region can be used for calibration (at step S37).

In the case that the control section 40 judges that the number is less than the predetermined threshold value p (NO at S336), the control section 40 judges that calibration image production is impossible (at step S38) and returns the process to step S34 of the flow chart shown in FIG. 3.

FIGS. 5 to 8 are explanatory views showing examples of calibration images produced by the calibration image producing section 401. In each figure, a frame image in the content data, serving as a base for calibration image production, is shown in the upper part, and a calibration image to be produced using the frame image is shown in the lower part. Each shows an example of a calibration image that is produced with respect to the respective RGB values in the case that 8-bit RGB values are divided into four predetermined monochrome levels of (255, 255, 255), (170, 170, 170), (85, 85, 85), and (0, 0, 0).

Figure 5:
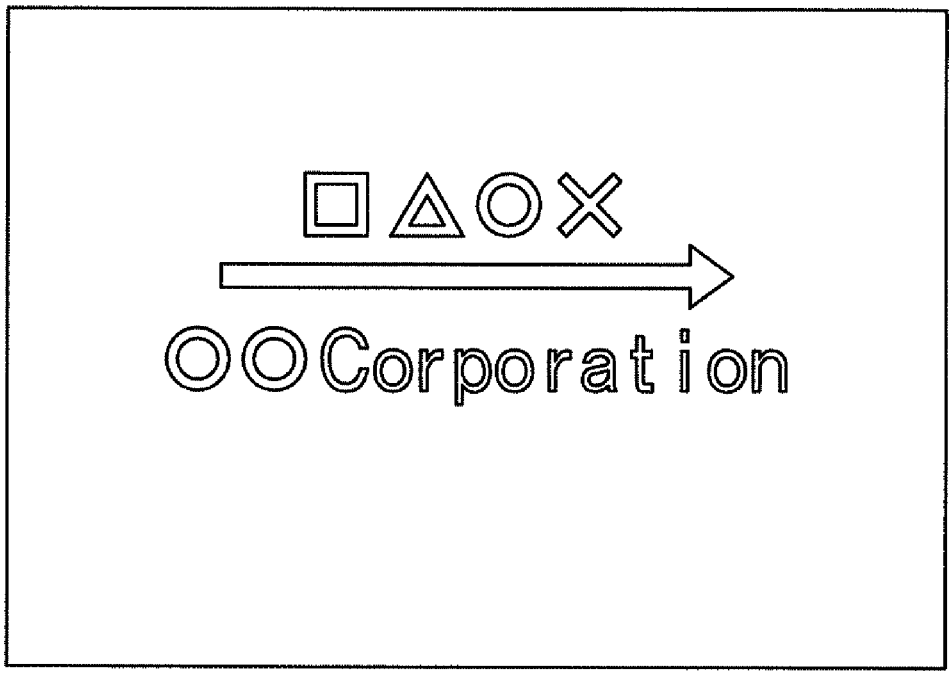
FIG. 5 is an explanatory view showing an example of a calibration image produced by the calibration image producing section.
Figure 5:
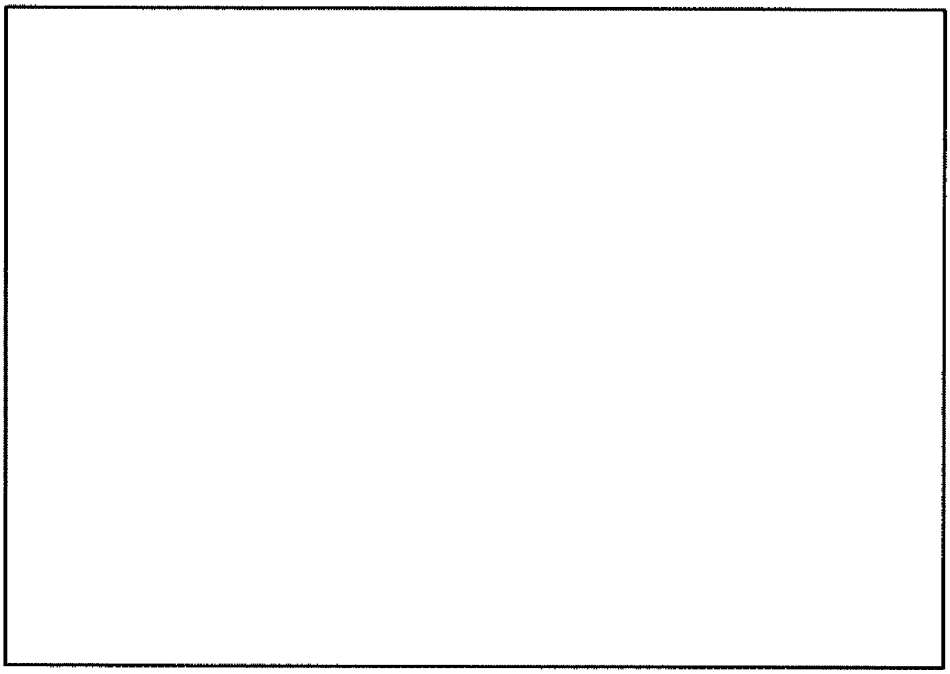

The example shown in the upper part of FIG. 5 is a frame image with frame number "N1" in content data for advertisement. This frame image is a frame image displaying the corporate statement of "oo Corporation" and "white" is used in the background. From the frame image shown in the upper part, pixels having the RGB values of the maximum luminance (255, 255, 255), the number of the pixels being equal to or more than the threshold value, are extracted, and a "white" calibration image shown in the lower part is produced.

Figure 6:
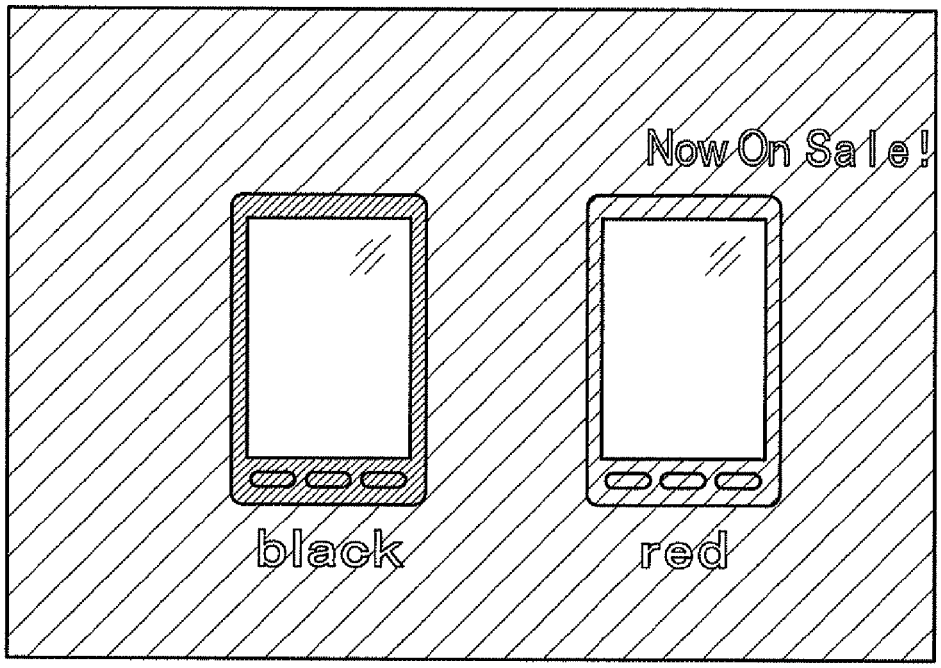
FIG. 6 is an explanatory view showing an example of a calibration image produced by the calibration image producing section.
Figure 6:
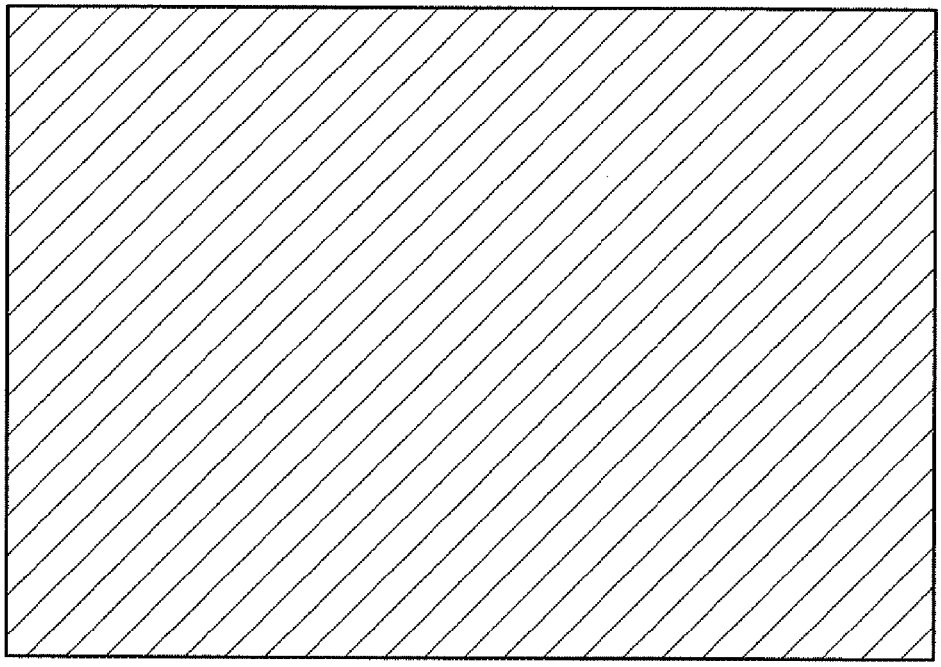

The example shown in the upper part of FIG. 6 is a frame image with frame number "N2" in the same content data as that of the frame image shown in FIG. 5. This frame image includes images of commercial products, and "light gray" is used in the background. From the frame image shown in the upper part, pixels having the RGB values of (170, 170, 170), the number of the pixels being equal to or more than the threshold value, are extracted, and a "light gray" calibration image shown in the lower part is produced.

Figure 7:
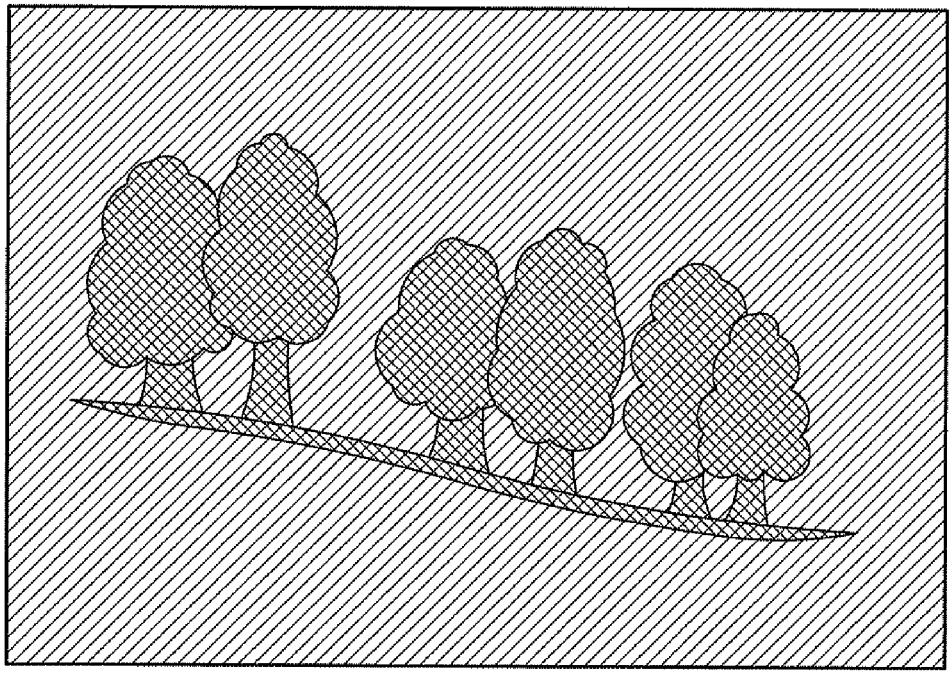
FIG. 7 is an explanatory view showing an example of a calibration image produced by the calibration image producing section.
Figure 7:
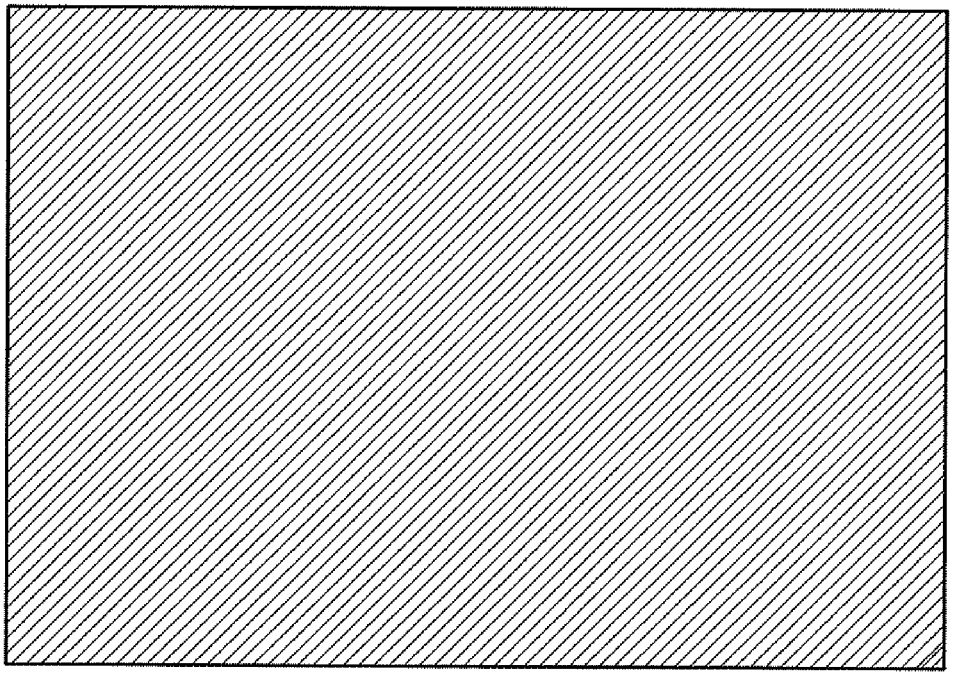

The upper part of FIG. 7 shows a frame image with frame number "N3" in the same content data as that of the frame images shown in FIGS. 5 and 6. This frame image includes a landscape image representing the image of a commercial product or service and "dark gray" is used in the background. From the frame image shown in the upper part, pixels having the RGB values of (85, 85, 85), the number of the pixels being equal to or more than the threshold value, are extracted, and a "dark gray" calibration image shown in the lower part is produced.

Figure 8:
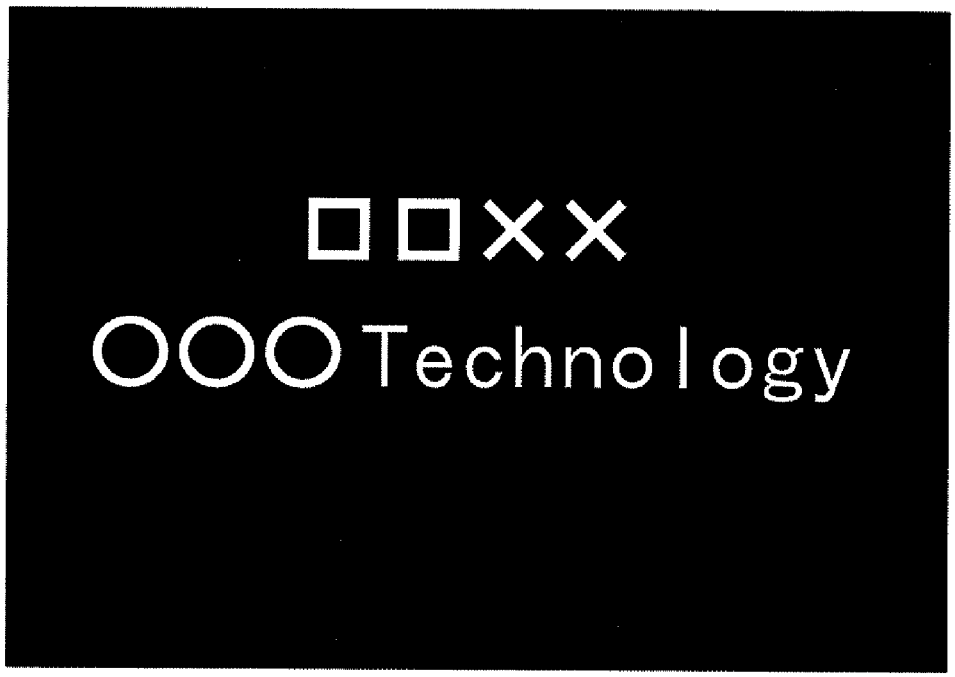
FIG. 8 is an explanatory view showing an example of a calibration image produced by the calibration image producing section.
Figure 8:
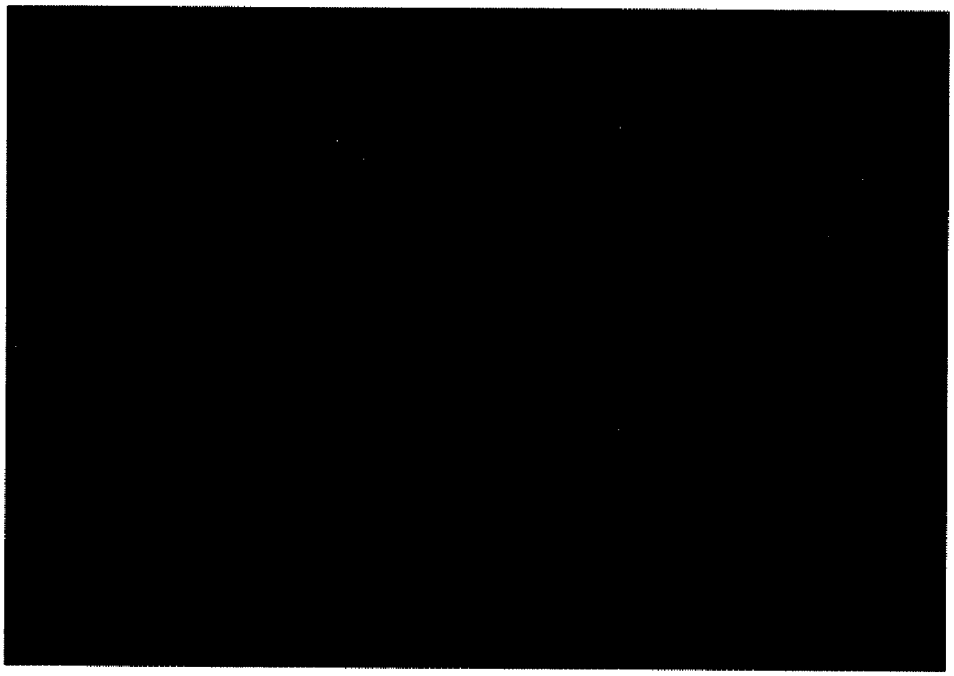

The upper part of FIG. 8 shows a frame image with frame number "N4" in the same content data as that of the frame images shown in FIGS. 5 to 7. This frame image is a frame image displaying the corporate statement of another corporation and "black" is used in the background. From the frame image shown in the upper part, pixels having the RGB values of (0, 0, 0), the number of the pixels being equal to or more than the threshold value, are extracted, and a "black" calibration image shown in the lower part is produced.

Next, an actual calibration process to be performed using such calibration images as shown in FIGS. 5 to 8. First, the control section 40 generates and outputs an image signal using the function of the image signal generating section 402.

Figure 9:
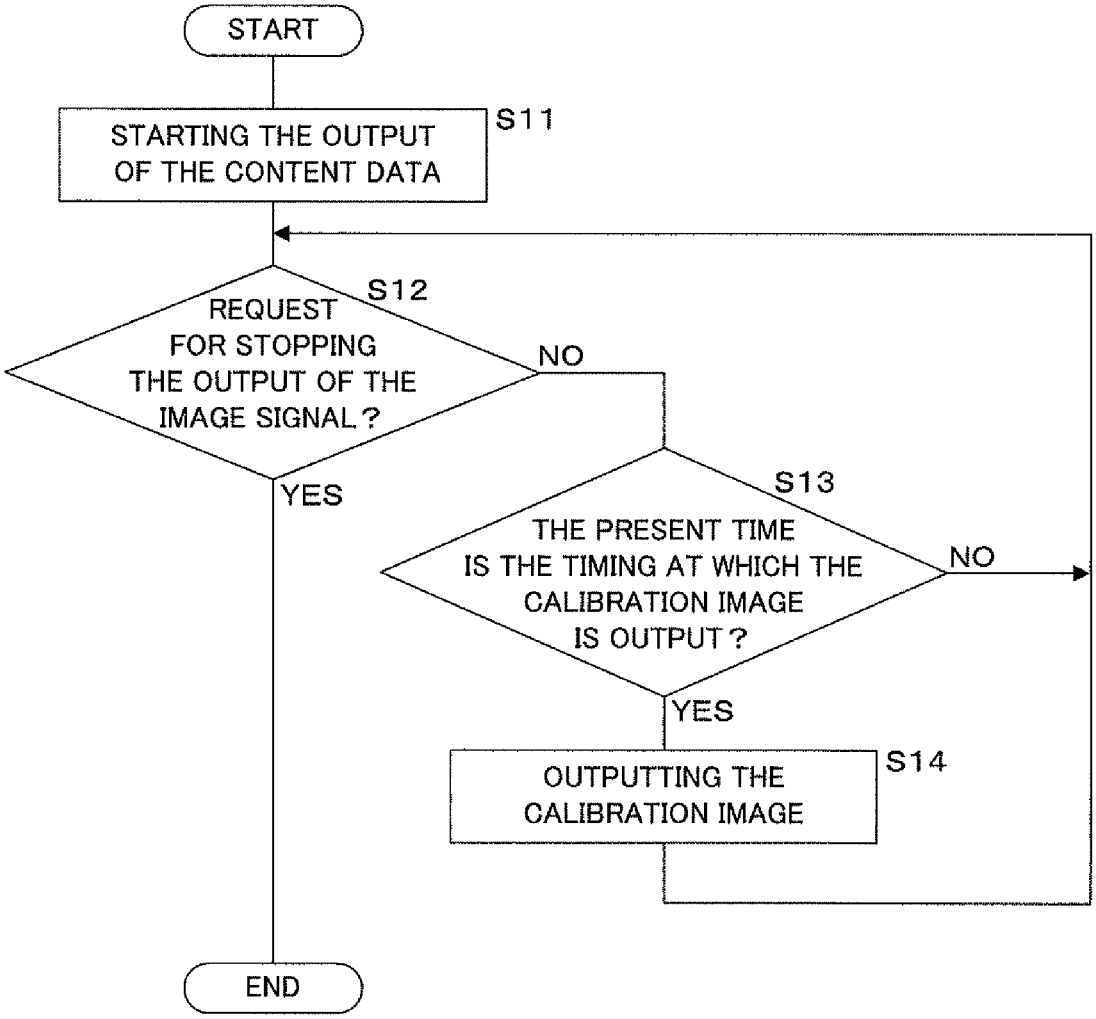
FIG. 9 is a flow chart showing an example of an image signal generating processing procedure.

FIG. 9 is a flow chart showing an example of an image signal generating processing procedure. In the case that the operator performed operation to instruct the reproduction of content through the operation section 25 of the signal processing device 2, the control section 20 receives a notice from the operation section 25 and recognizes it and then outputs control-use data requesting the output start of an image signal to the control device 4. When the control section 40 of the control device 4 receives the control-use data requesting the output start of the image signal from the input/output section 44, the control section 40 performs the following process.

The control section 40 reads the content data used as the base for calibration image production and starts the output of the content data to the signal processing device 2 via the input/output section 44 (at step S11). Hence, the reproduction of the content is started at the display section 1. The control section 40 keeps outputting the image signal at an appropriate transmission rate so as to be in time with the output of the image signal from the signal processing device 2 and the display rate in the display section 1.

Next, the control section 40 judges whether control-use data requesting for stopping the output of the image signal is input from the signal processing device 2 (at step S12). In the case that the control section 40 judges that the control-use data requesting for stopping the output of the image signal is input (YES at S12), the control section 40 ends the process for outputting the image signal. The control-use data requesting for stopping the output of the image signal is output from the signal processing device 2 to the control device 4 when the operator performed operation to instruct the output stop of the content through the operation section 25 of the signal processing device 2 and when the control section 20 receives a notice from the operation section 25 and recognizes the notice.

In the case that the control section 40 judges that the above-mentioned control-use data requesting for stopping the output of the image signal is not input (NO at S12), the control section 40 repeats the following process until the control-use data is input.

Using the function of the image signal generating section 402, the control section 40 judges whether the present time is the timing at which the calibration image is output (at step S13). More specifically, at step S13, the control section 40 specifies the frame number of the image signal being output and judges whether the frame number is a number ahead of the frame number or the exact frame number of the frame image used as the base for producing the calibration image and stored in the calibration information 411.

In the case that the control section 40 judges that the present time is the timing at which the calibration image is output (YES at S13), the control section 40 inserts the calibration image corresponding to the frame number or uses the calibration image for replacement on the basis of the calibration information 411 using the function of the image signal generating section 402 and outputs the calibration image (at step S14). More specifically, in the case of inserting the calibration image ahead of the frame image used as the base, when judging that the frame number is ahead of the frame number of the frame image used as the base, the control section 40 designates, behind the frame number, the display time of the calibration image so that the image is displayed for a ½ frame time on the basis of the frame rate and outputs the image. On the other hand, in the case of replacing the frame image used as the base with the calibration image, when judging that the frame number is the frame number of the frame image used as the base, the control section 40 outputs the calibration image instead of the frame image used as the base. Alternatively, in the case of inserting the calibration image behind the frame image used as the base, the control section 40 designates, behind the frame number of the frame image used as the base, the display time of the calibration image so that the image is displayed for a ½ frame time on the basis of the frame rate and outputs the image.

After outputting the calibration image, the control section 40 returns the process to step S12. On the other hand, in the case that the control section 40 judges that the present time is not the timing at which the calibration image is output (NO at S13), the control section 40 returns the process to step S12.

As a result, a new image signal in which the calibration image is inserted or used for replacement is generated and output. Without being limited to the above-mentioned configuration, the present invention may have a configuration wherein the image signal generating section 402 generates a new image signal in which the calibration image is inserted or used for replacement on the basis of the content data having been read and temporarily stores the new image signal in the storage section 41 or the storage device 5, and reads the stored new image signal when the calibration process is performed and then outputs the image signal.

Figure 10:
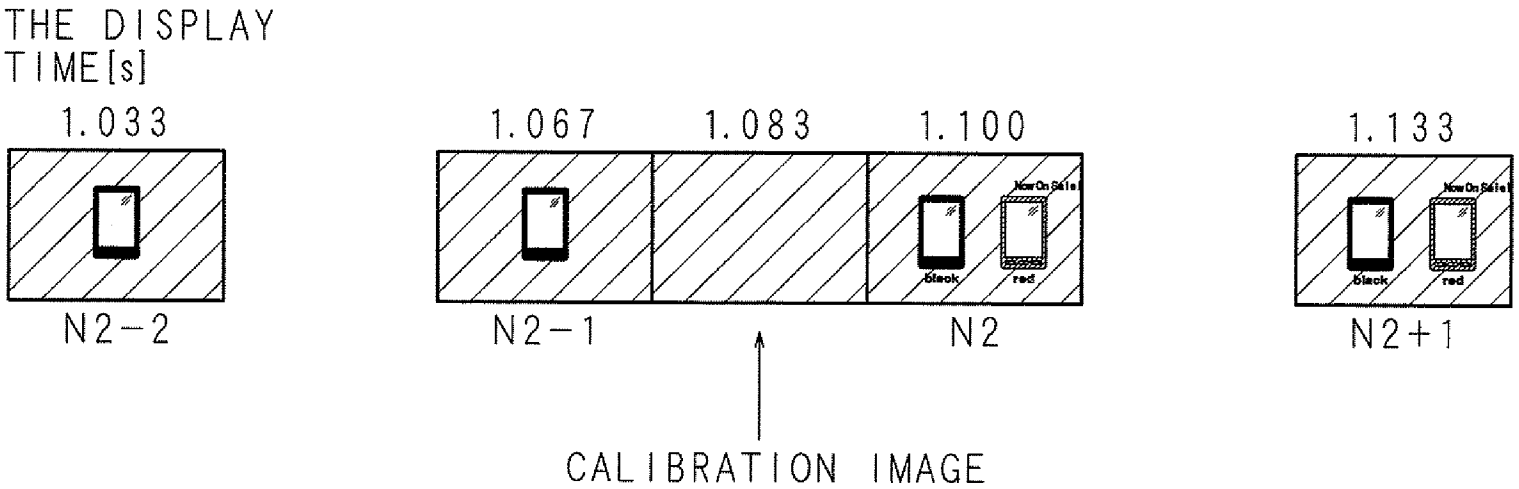
FIG. 10 is an explanatory view schematically showing an example of an image signal generated by the image signal generating section according to Embodiment 1.
Figure 11:
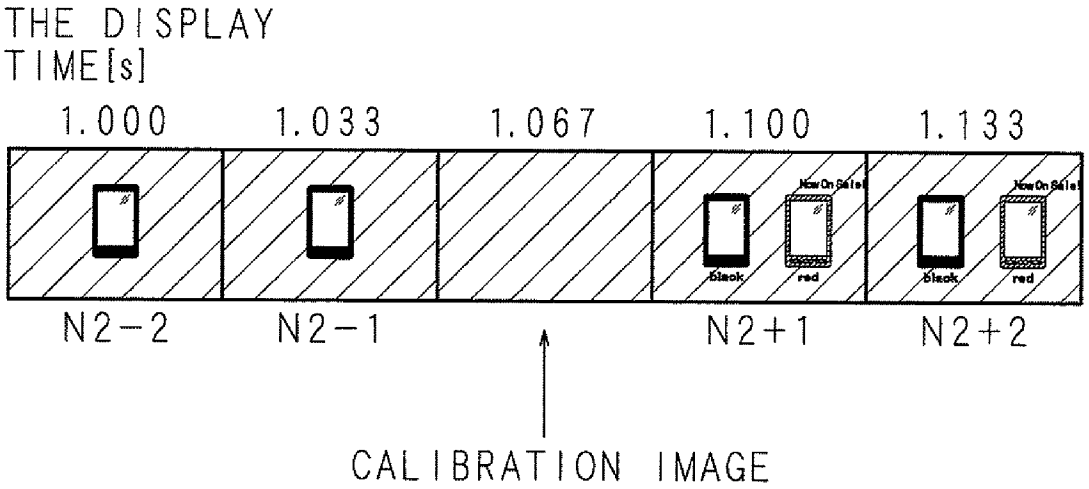
FIG. 11 is an explanatory view schematically showing an example of an image signal generated by the image signal generating section according to Embodiment 1.

FIGS. 10 and 11 are explanatory views schematically showing examples of image signals generated by the image signal generating section 402 according to Embodiment 1. Both FIGS. 10 and 11 show frame images based on image signals in time sequence. The frame rate is 30 frames/sec, and the display time (the time elapsed from the first frame image) of each frame image is indicated in seconds [s].

In FIG. 10, in the case that a calibration image is inserted between frame images, the frame images ahead of and behind the calibration image are shown in time sequence. In the example shown in FIG. 10, frame number "N2" is stored in the calibration information 411. The control section 40 specifies the frame number being output using the function of the image signal generating section 402. In the case that the control section 40 can specify that the frame number is "N2–1", the control section 40 inserts the calibration image having a ½ frame time (0.017 sec) ahead of the next frame number "N2" and outputs the calibration image. As shown in FIG. 10, the backgrounds of the calibration image and the next frame image have almost identical luminance or color. Hence, even if the calibration image is displayed, the viewer does not have uncomfortable feeling. Although the expression "almost identical luminance or color" is used herein, the luminance or color in the background of the calibration image is not required to be identical to that of the next frame image, but the difference therebetween should only be within a range in which the viewer does not have uncomfortable feeling for the images to be displayed. The range in which the viewer does not have uncomfortable feeling may be determined by many viewers participated using various images. In this sense, the above-mentioned expression "almost" identical luminance or color is used.

In FIG. 11, in the case that a frame image is replaced with a calibration image, the frame images ahead of and behind the calibration image are shown in time sequence. Also in the example shown in FIG. 11, frame number "N2" is stored in the calibration information 411. The control section 40 specifies the frame number being output using the function of the image signal generating section 402. In the case that the control section 40 can specify that the frame number being output is "N2", the control section 40 outputs the calibration image. The control section 40 does not output the image signal of the original frame image (N2). As shown in FIG. 11, the backgrounds of the calibration image and the next frame image have almost identical luminance or color. Hence, even if the calibration image is displayed, the viewer does not have uncomfortable feeling.

In the example shown in FIG. 11, the frame time during which the calibration image is displayed is 0.33 sec, longer than 0.017 sec in the case of the example shown in FIG. 10. Hence, even if the capturing timing of the capturing device 3 described later has a variation of approximately one frame time (0.033 sec), the calibration image can be captured. However, the variations in the shutter speed and the capturing time are required to be within a one-frame time.

Even in the case that a calibration image is inserted, the calibration image may be inserted in a one-frame time as shown in FIG. 11. In this case, however, the image signal to be output takes a longer time. It is preferable that the calibration image should be output so as to be displayed in a ½ frame time between such frames as shown in FIG. 10 so that capturing timing control does not become complicated and unnaturalness is not generated in a moving image to be displayed. Furthermore, in the case that the display system is caused to function as digital signage, the length of content to be reproduced is negligible to the viewer in comparison with television broadcasting or the like. Hence, it is conceived that no problem occurs even if a configuration is used in which the calibration image is inserted in a one-frame time so that the calibration image can be captured securely.

Figure 12:
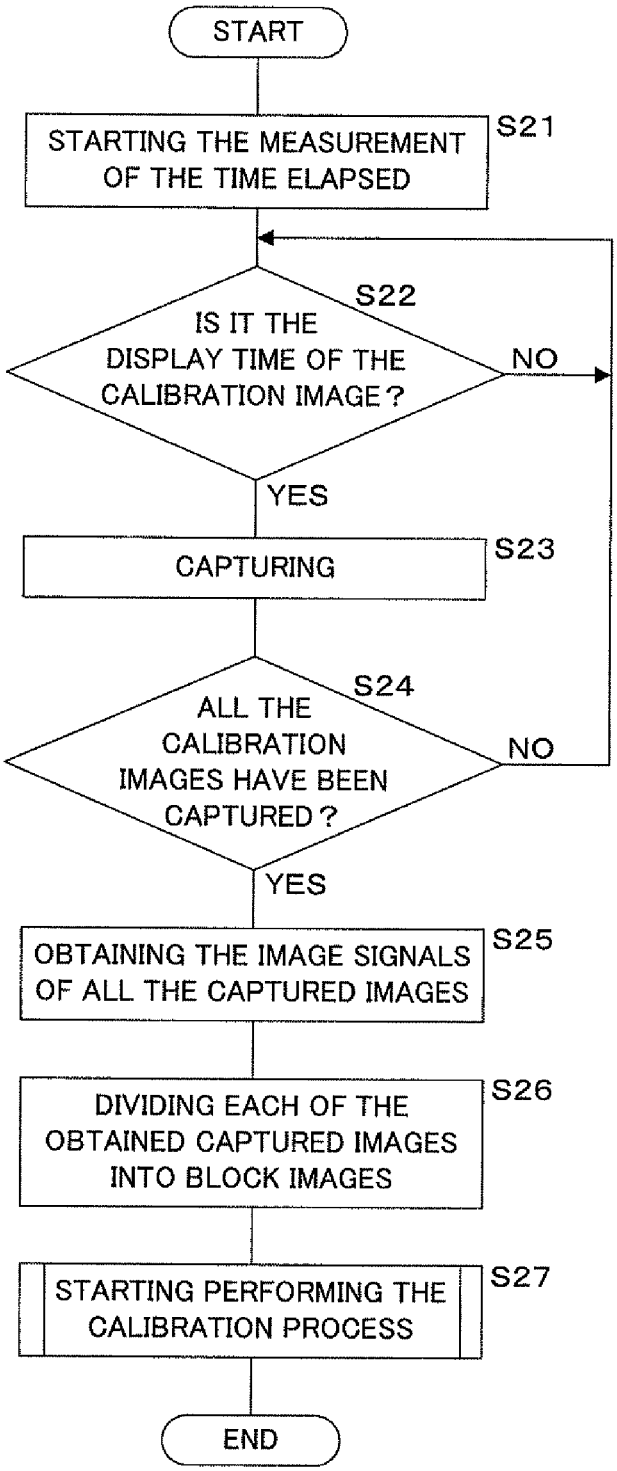
FIG. 12 is a flow chart showing an example of a processing procedure performed by the timing specifying section and the calibration section of the control device.

Next, a procedure in which calibration is performed on the basis of the images shown in FIGS. 10 and 11 will be described. FIG. 12 is a flow chart showing an example of a processing procedure performed by the timing specifying section 403 and the calibration section 404 of the control device 4. When the control section 40 starts the output of a new image signal to the signal processing device 2, the control section 40 performs the following process and carries out calibration using the functions of the timing specifying section 403 and the calibration section 404.

The control section 40 starts the measurement of the time elapsed from the start of the output of the image signal (at step S21).

Using the function of the timing specifying section 403 and on the basis of the time elapsed from the start of the output of the image signal, the control section 40 judges whether the present time is the display time of the calibration image (at step S22). When the calibration image is output by the control section 40 using the image signal generating section 402, the display time is designated and the calibration image is output. Hence, this should be memorized and referred to.

In the case that the control section 40 judges that the present time is the display time (YES at S22), the control section 40 outputs a capturing request signal from the connection section 45 to the capturing device 3 and causes the capturing device 3 to perform capturing (at step S23). In the case that the control section 40 judges that the present time is not the display time (NO at S22), the control section 40 returns the process to step S22.

After causing the capturing device 3 to perform capturing, the control section 40 judges whether all the calibration images have been captured (at step S24). More specifically, the control section 40 should only judge whether all the calibration images having a plurality of predetermined different luminance or color levels have been captured or whether the number of capturing times coincides with the number of frame numbers stored in the calibration information 411. In the case that the control section 40 judges that all the calibration images have not been captured (No at S24), the control section 40 returns the process to step S22. In the case that the control section 40 judges that all the calibration images have been captured (YES at S24), the control section 40 obtains the image signals of all the captured images using the function of the calibration section 404 (at step S25). However, the control section 40 may obtain an image signal each time capturing is performed.

It is preferable that the control section 40 should check beforehand whether the captured images obtained at step S25 are images obtained by actually capturing the calibration images and whether the measurement values described later have proper values by following the procedure described below. The control section 40 extracts the maximum values $R_{max}$, $G_{max}$ and $B_{max}$ and the minimum values $R_{min}$, $G_{min}$ and $B_{min}$ of the RGB values of all the pixels in the captured images. The control section 40 sets $\Delta_R$, $\Delta_G$, $\Delta_B$ as the allowable judgment values for the respective RGB values. In the case that these values satisfy the following three expressions, the control section 40 judges that the calibration images have been able to be captured actually and color measurement has been able to be performed; in the case that even one of the expressions is not satisfied, the control section 40 judges that color measurement has not been performed.

$$R_{max}-R_{min}\leq\Delta_R$$

$$G_{max}-G_{min}\leq\Delta_G$$

$$B_{max}-B_{min}\leq\Delta_B$$

$\Delta_R$, $\Delta_G$, $\Delta_B$ are respectively set to "5" for example.

Using the function of the calibration section 404, the control section 40 divides each of the obtained captured images into block images according to the arrangement of the display devices in the multiple display system 10 (at step S26). Information for identifying each of the multiple display system 10 is related to each block image. Using the function of the calibration section 404 and on the basis of the divided block images, the control section 40 starts performing the calibration process for each display device 10 (at step S27). After the calibration process is completed, the image signal to be output is corrected by the correction process (at steps S706 and S710 described later) performed by the calibration section 404 or by the correction process performed by the signal processing device 2 on the basis of correction information 412 to be output.

Figure 13:
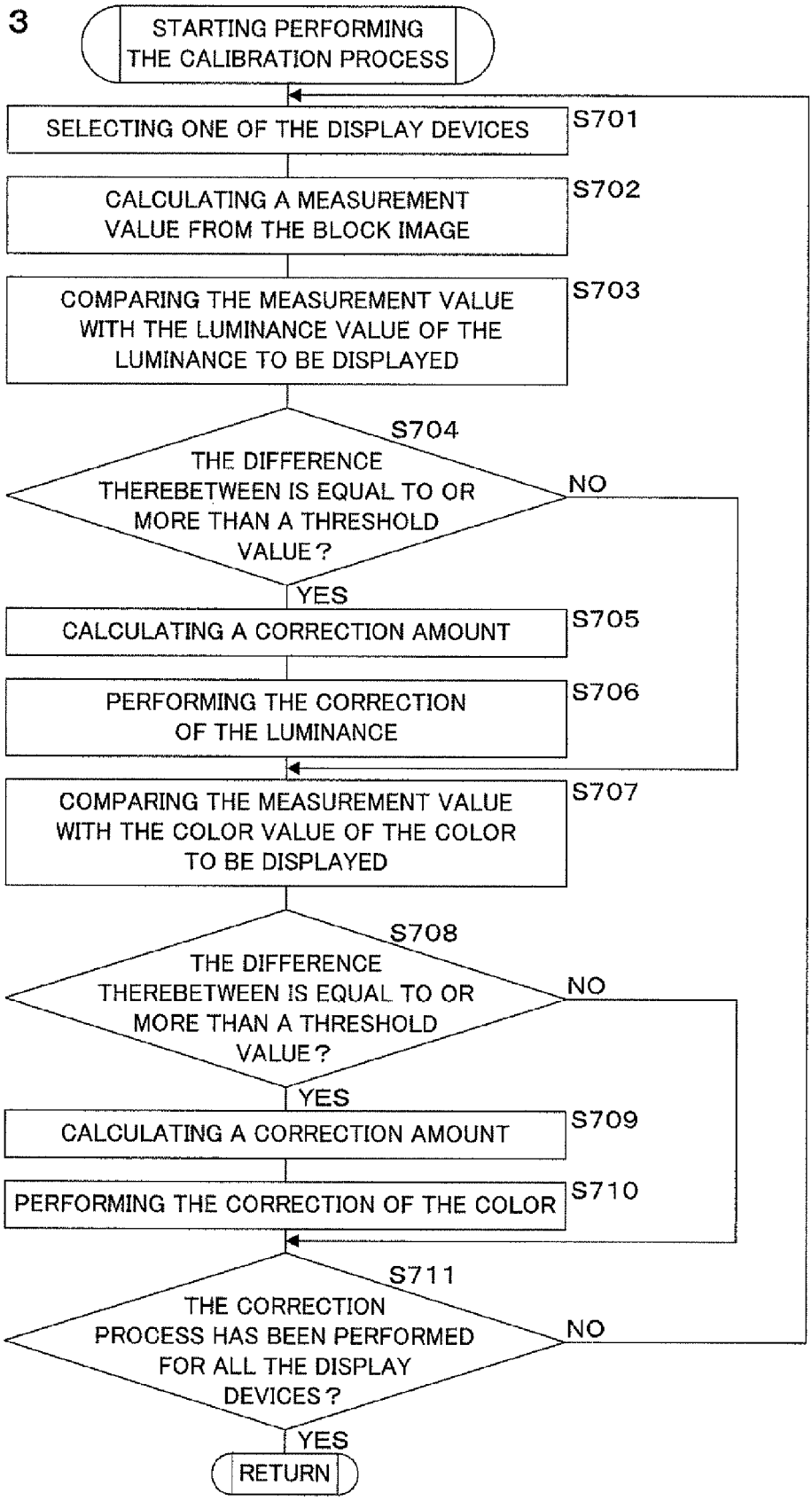
FIG. 13 is a flow chart showing an example of the detailed processing procedure of the calibration process at step S27 shown in FIG. 12.

FIG. 13 is a flow chart showing an example of the detailed processing procedure of the calibration process at step S27 shown in FIG. 12. The control section 40 performs the following process using the calibration section 404.

The control section 40 selects one of the display devices 10 (at step S701) and calculates a measurement value (luminance value or color value) from the block image corresponding to the selected display device 10 by performing a predetermined arithmetic operation (at step S702). As the predetermined arithmetic operation, the control section 40 calculates, for example, the average value of the pixel values (RGB values) of the pixels in the region in which the calibration region was captured, using the function of the calibration section 404. Another arithmetic operation method for calculating a median value, for example, may also be used.

Next, using the calibration section 404, the control section 40 compares the measurement value for the selected display device 10 with the luminance value of the luminance to be displayed (at step S703). The control section 40 judges whether the difference therebetween is equal to or more than a threshold value (at step S704). In the case that the control section 40 judges that the difference is equal to or more than the threshold value (YES at step S704), the control section 40 calculates a correction amount corresponding to the measurement value that is equal to or more than the threshold value (at step S705) and performs the correction of the luminance (at step S706). In the case that the control section 40 judges that the difference in luminance is less than the threshold value (NO at step S704), the control section 40 does not require to correct the luminance for the selected display device 10 and advances the process to the next step S707.

The control section 40 compares the measurement value for the selected display device 10 with the color value of the color to be displayed (at step S707). The control section 40 judges whether the difference therebetween is equal to or more than a threshold value (at step S708). In the case that the control section 40 judges that the difference is equal to or more than the threshold value (YES at step S708), the control section 40 calculates a correction amount corresponding to the measurement value that is equal to or more than the threshold value (at step S709) and performs the correction of the color value (at step S710). In the case that the control section 40 judges that the difference in color is less than the threshold value (NO at step S708), the control section 40 advances the process to the next step S711.

It is conceived that various methods may be used for the correction to be performed. A method may be used in which the control section 40 compares the calculated measurement values of the display devices 10 with one another and performs correction in the case that the difference between the maximum measurement value and the minimum measurement value is equal to or more than a predetermined threshold value. Furthermore, as the threshold value of the difference, a value at which the difference is recognized by visual check may be set beforehand, or a configuration may be used in which the threshold value is set beforehand on the basis of the result of a measurement performed using a colorimeter. Using the function of the calibration section 404, the control section 40 corrects, among the measurement values respectively corresponding to the display device of the multiple display system 10, the luminance values of the image signals to be output to the display devices 10 other than the display device 10 having the lowest luminance value so as to be made coincident with the measurement value corresponding to the display device 10 having the lowest luminance value. In other words, the control section 40 performs correction so as to lower the luminance displayed on the other display devices 10. Furthermore, the calibration section 404 may perform correction so that the image signals to be output to the display devices 10 in which the difference between each measurement value and the luminance value or the color value to be displayed is equal to or more than a predetermined value have the luminance or color to be displayed. In particular, in the case that the display section 1 is formed of a single display device 10, this method is used.

It may be possible that the correction amount of the luminance or color corresponding to each display device 10 is stored as the correction information 412 in the storage section 41, the control section 40 outputs the image signal, the correction section 404 outputs the correction information 412 as the information of each display device 10 to the signal processing device 2, and the image processing section 23 of the signal processing device 2 corrects the image signal to be input on the basis of the correction information 412 corresponding to each display device 10. The signal processing device 2 can correct the RGB values of various image signals to be input by generally using the correction information 412 obtained from the correction section 404.

The control section 40 judges whether the correction process has been performed for all the display devices 10 (at step 711). In the case that the control section 40 judges that the correction process has not been performed, the control section 40 returns the process to step 701, selects the next display device 10 (at step S701), and repeats the following process.

In the case that the control section 40 judges that the correction process has been performed for all the display devices 10 (YES at S711), the control section 40 ends the correction process and returns the process to step S21 of the flow chart shown in FIG. 12. Then, the image signals to be output to the group of the display devices 10 of the display section 1 are corrected.

As described above, the calibration image can be displayed without causing uncomfortable feeling in the image signal based on the content data for advertisement to be displayed on the display section 1 so as to deliver the function of digital signage and can be used for calibration.

Embodiment 2

In the configuration according to Embodiment 1, a calibration image is inserted or used for replacement ahead of or behind the frame image that is judged first that the calibration image can be produced. In Embodiment 2, a calibration image is inserted or used for replacement ahead of or behind the most similar frame image.

The configuration of the display system according to Embodiment 2 is similar to that according to Embodiment 1, except for the following processing procedure performed by the control section 40 of the control device 4. Hence, the commonly used components are designated by the same numerals and their detailed descriptions are omitted.

Figure 14:
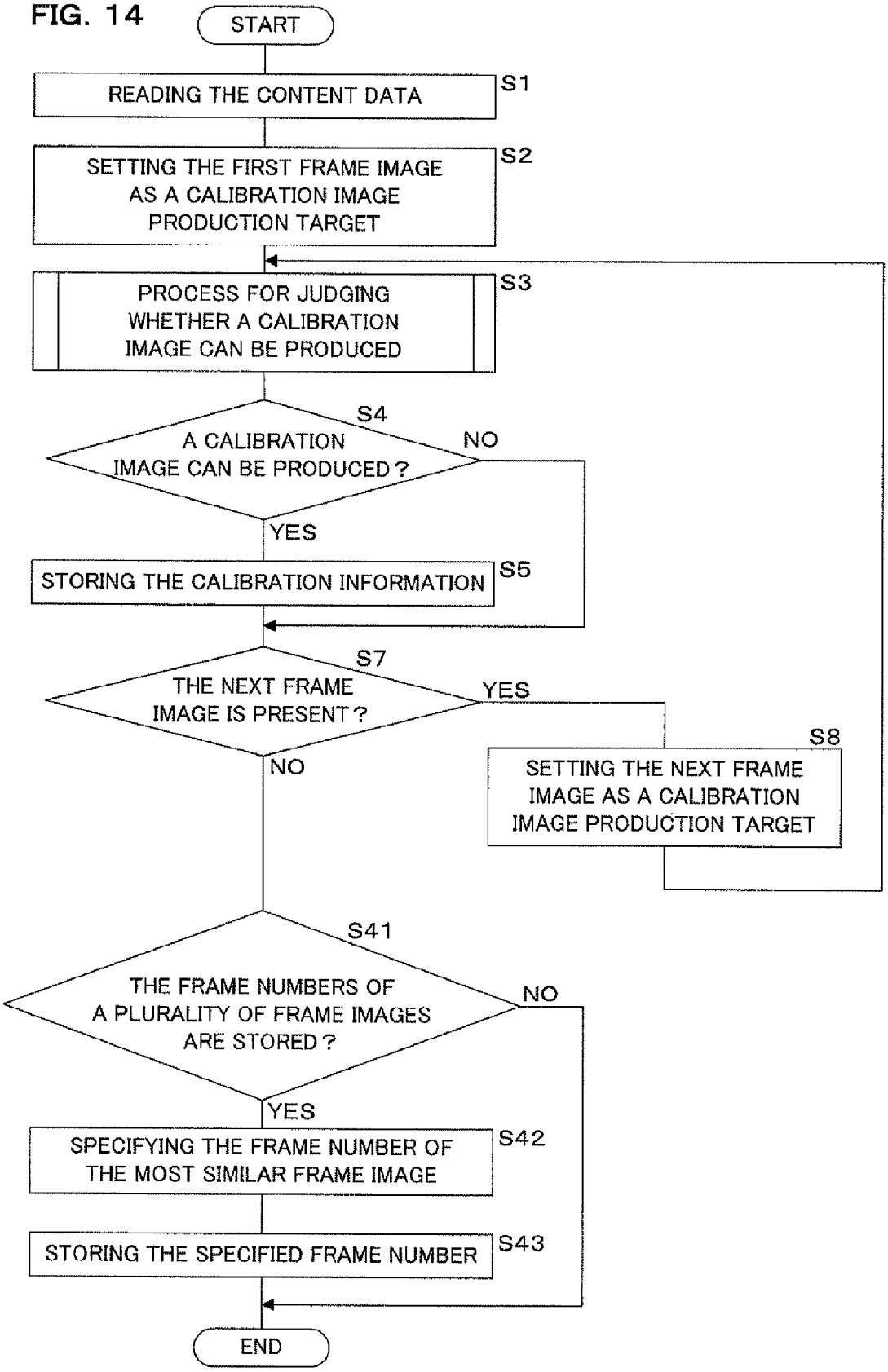
FIG. 14 is a flow chart showing an example of a processing procedure performed by the calibration image producing section of a control device according to Embodiment 2.

FIG. 14 is a flow chart showing an example of a processing procedure performed by the calibration image producing section 401 of the control device 4 according to Embodiment 2. Using the function of the calibration image producing section 401, the control section 40 of the control device 4 according to Embodiment 2 performs a process beforehand according to the following procedure before performing calibration using the content data read from the storage device 5. In the following processing procedure, the same steps as those shown in the flow chart shown in FIG. 3 are designated by the same step numbers, and their detailed descriptions are omitted.

The control section 40 reads the content data from the storage device 5 (at S1) and uses the first frame image (frame number 0 (zero)) as a calibration image production target (at S2).

The control section 40 performs a process for judging whether a calibration image can be produced actually from the frame image serving the tentative calibration image production target (at S3) and judges whether the calibration image can be produced (at S4). In the case that the control section 40 judges that the calibration image cannot be produced (NO at S4), the control section 40 advances the process to the next step S7.

In the case that the control section 40 judges that the calibration image can be produced (YES at S4), the control section 40 stores the calibration information 411 including the frame number of the frame image that is judged that the production is possible and the luminance or color information of the calibration image in the storage section 41 (at S5). At this time, it is desired that the control section 40 should also store the information on the variable M that is counted in the detailed process in step S3.

Next, the control section 40 judges whether the next frame image is present (at S7). In the case that the control section 40 judges that the next frame image is present (YES at S7), the control section 40 sets the next frame image as a calibration image production target (at S8) and returns the process to step S3.

In the case that the control section 40 judges that the next frame image is not present (NO at S7), since the process for judging whether calibration image production is possible has been performed for all the frame images, the control section 40 refers to the calibration information 411 stored in the storage section 41, and then judges whether the frame numbers of a plurality of frame images having the same luminance or color as that of the calibration target are stored (at step S41). In the case that the control section 40 judges that the frame numbers of the plurality of frame images are not stored (NO at S41), the control section 40 ends the process.

In the case that the control section 40 judges that the frame numbers of the plurality of frame images are stored (YES at S41), the control section 40 specifies the frame number of the most similar frame image (at step S42). At this time, the control section 40 may specify a similar frame image by specifying the frame number of the frame image in which the value of the variable M counted by the process at step S3 is the largest. Alternatively, it may be possible that a preference order is given to the similarity of each frame image using another known method and the frame number of a frame image having a high preference order is specified.

The control section 40 stores the frame number of the frame image that is specified as the most similar frame image in the calibration information 411 (at step S43) and ends the process.

As a result, when a new image signal is generated on the basis of the stored calibration information 411, the calibration image is inserted ahead of or behind the frame image that was judged to be the most similar frame image or replaced with the frame image or used for replacement ahead of or behind the frame image. Hence, the calibration image is displayed so that the viewer does not have uncomfortable feeling to the maximum extent.

Embodiment 3

In Embodiment 3, a frame image in which a scene change occurs is detected from an image signal based on content data, the so-called cut point detection is performed, and a calibration image is inserted or used for replacement ahead of or behind the frame image at the cut point.

The configuration of the display system according to Embodiment 3 is similar to that according to Embodiment 1, except for the following processing procedure performed by the control section 40 of the control device 4. Hence, the commonly used components are designated by the same numerals and their detailed descriptions are omitted.

Figure 15:
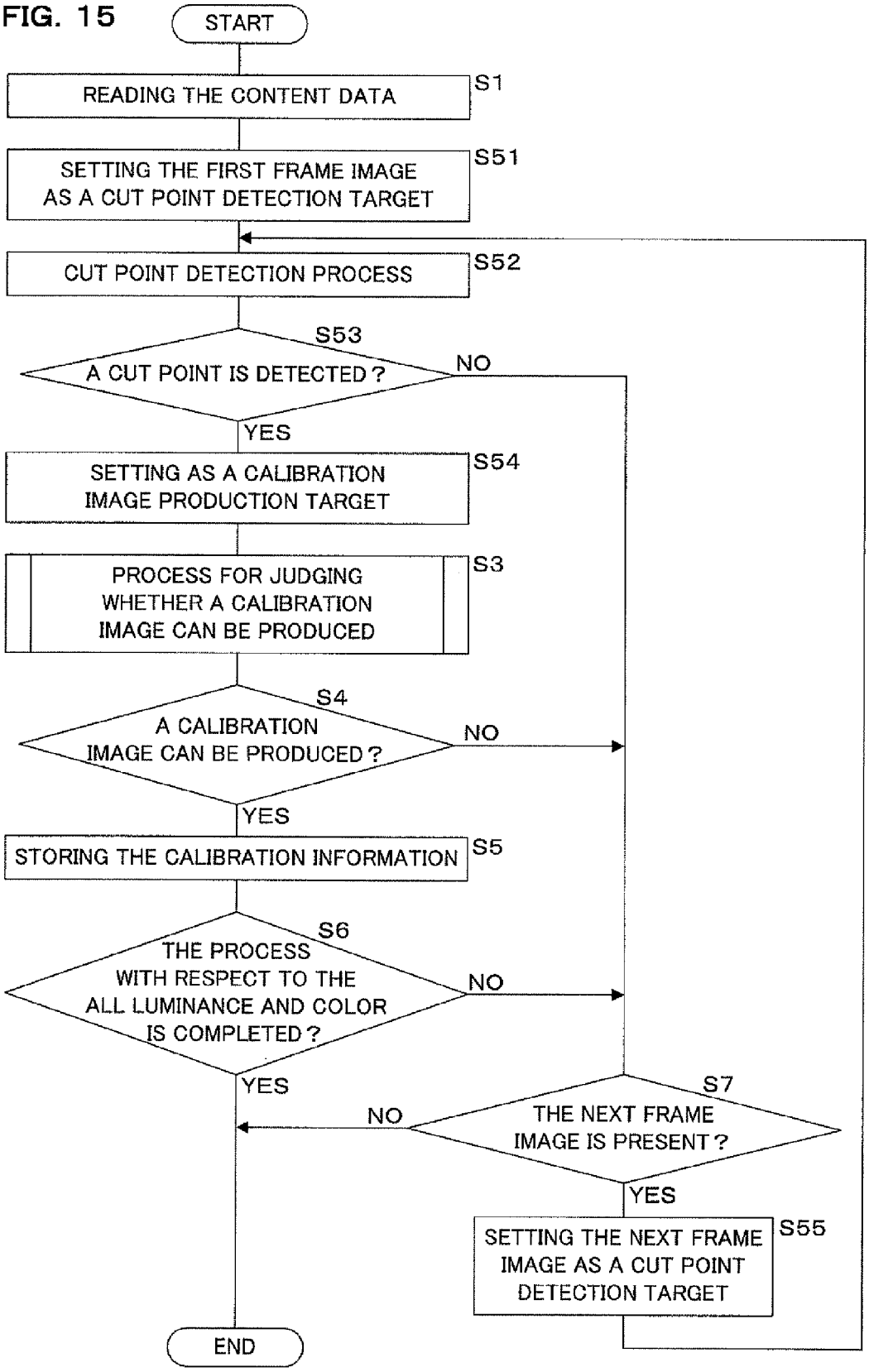
FIG. 15 is a flow chart showing an example of a processing procedure performed by the calibration image producing section of a control device according to Embodiment 3.

FIG. 15 is a flow chart showing an example of a processing procedure performed by the calibration image producing section 401 of the control device 4 according to Embodiment 3. Using the function of the calibration image producing section 401, the control section 40 of the control device 4 according to Embodiment 3 performs a process beforehand according to the following procedure before performing calibration using the content data read from the storage device 5.

The control section 40 reads the content data from the storage device 5 (at step S1) and sets the first frame image as a cut point detection target (at step S51).

The control section 40 performs a cut point detection process for the frame image having been set as the cut point detection target (at step S52).

As a method for performing the cut point detection at step S52, a known algorithm, such as a method in which the distribution (histogram) of luminance or color is compared between the target frame image and the preceding frame image or a motion vector prediction method, should only be used. More specifically, as a histogram comparison method, a method of using the Bhattacharyya distance of a color space histogram is available. In this case, the control section 40 generates the histogram of the luminance levels of all pixels (the distribution of the number of pixels having each luminance level in the case that luminance is divided into predetermined levels). The control section 40 normalizes the generated histogram by the total number of pixels (for example, 10000) and calculates the predetermined Bhattacharyya distance between the histogram and the histogram generated for the preceding frame image. If the value of the distance is more than a threshold value (for example, 0.3), the control section 40 judges that a cut point is present between the frame image and the preceding frame image. In the case that the color of each pixel of the frame image is represented by RGB values, the luminance can be calculated using the following expression.

$$\text{Luminance } Y=0.29891\times R+0.58661\times G+0.11448\times B$$

However, it is not essential to generate the histogram. The variance values of the luminance value Y in the frame image should only be calculated. Furthermore, it may be possible that instead of using luminance, a variance value is calculated for each of color components R, G and B, and a judgment is made as to whether a cut point is present depending on whether the variance value of either one of the plurality of color components (R, G, B) is equal to or more than a threshold value.

Next, the control section 40 judges whether a cut point is detected actually in the frame image having been set as the cut point detection target (at step S53). In the case that the control section 40 judges that the cut point is detected (YES at S53), the frame image preceding the frame image have been set as the cut point detection target is set as a calibration image production target (at step S54). The control section 40 then performs the following processes, that is, a production judgment process (at S3), a process for performing production possibility judgment (at S4), a process for storing the calibration information 411 (at S5), and a judgment as to whether all the processes with respect to luminance or color are completed (at S6).

At step S54, the control section 40 may set the frame image having been set as the cut point detection target as a calibration image production target.

In the case that the control section 40 judges that no cut point is detected (NO at S53), the control section 40 judges whether the next frame image is present (at S7). In the case that the control section 40 judges that the next frame image is present (YES at S7), the control section 40 sets the next frame image as a cut point detection target (at step S55) and returns the process to step S52.

Hence, the frame image in which the cut point is detected, that is, only the frame image ahead of or behind a frame image in which a scene change occurs is used as the target for the judgment as to whether a calibration image can be produced. As a result, the calibration image is produced from the frame image in which the cut point is detected.

Figure 16:
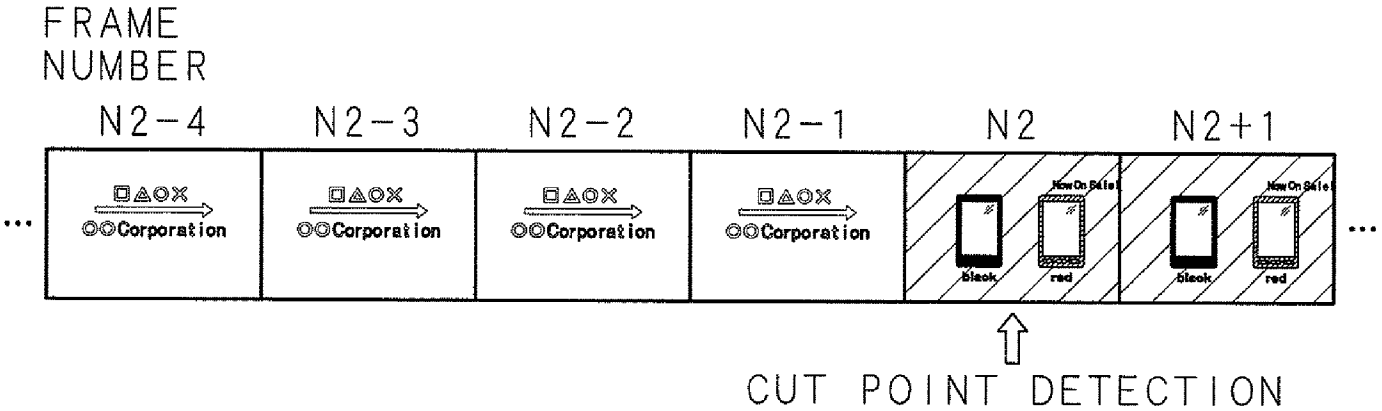
FIG. 16 is an explanatory view showing an example of a frame image in which a cut point is detected.

FIG. 16 is an explanatory view showing an example of a frame image in which a cut point is detected. The respective rectangles in FIG. 16 represent frame images. The frames ranging from a frame with frame number "N2−4" to a frame with frame number "N2+1" are arranged and shown in time sequence. The control section 40 can judge that a scene change occurs in the frame image with frame number "N2" and that a cut point is present between the frame image and the preceding frame image (N2−1).

Since the frame image in which the cut point is detected is used as a calibration image production target, even if the produced calibration image is inserted or used for replacement ahead of or behind the cut point, when the image is displayed, the viewer does not have uncomfortable feeling.

FIGS. 17 to 20 are explanatory views schematically showing examples of image signals generated by the image signal generating section 402 according to Embodiment 3. FIGS. 17 to 20 show frame images based on the image signals in time sequence. The frame rate is 30 frames/sec, and the display time (the time elapsed from the first frame image) of each frame image is indicated in seconds [s].

Figure 17:
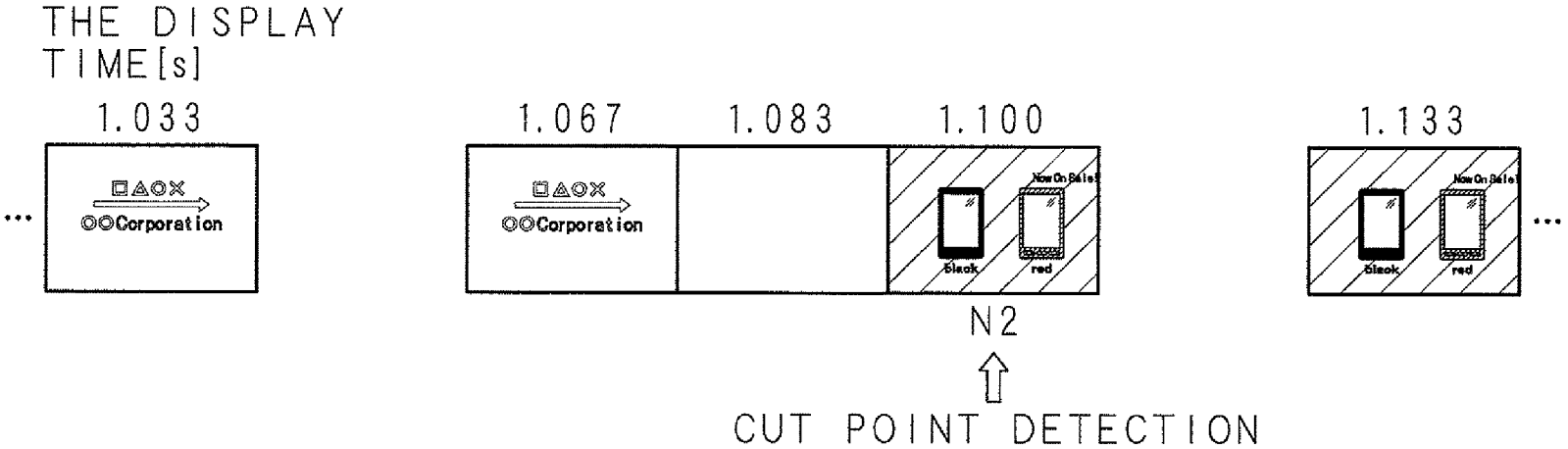
FIG. 17 is an explanatory view schematically showing an example of an image signal generated by an image signal generating section according to Embodiment 3.
Figure 18:
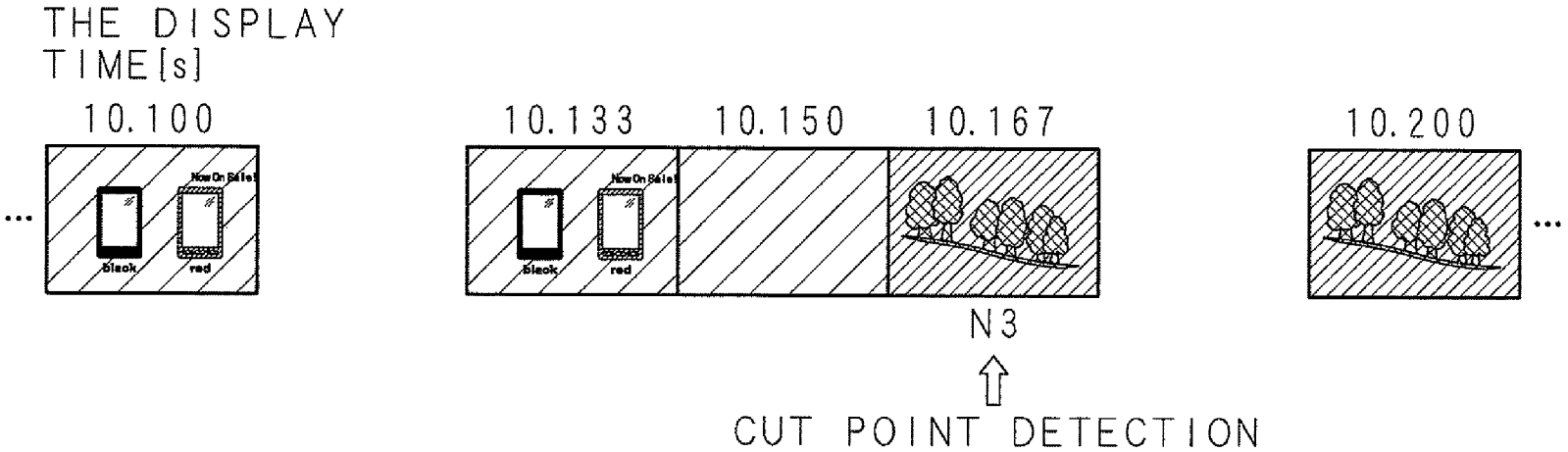
FIG. 18 is an explanatory view schematically showing an example of an image signal generated by the image signal generating section according to Embodiment 3.

In FIGS. 17 and 18, in the case that a calibration image is inserted between frame images, the frame images ahead of and behind the calibration image are shown in time sequence.

In the example shown in FIG. 17, a cut point is detected in the frame image with frame number "N2" between the frame image and the preceding frame image. Hence, the frame image with frame number "N2−1" is set as a calibration image production target. In the frame image with frame number "N2−1", many regions thereof are occupied by "white" and the control section 40 judges that a calibration image with white pixels having RGB values of (255, 255, 255) can be produced. The frame number "N2−1" is stored in the correction information 411. Also in Embodiment 3, the control section 40 performs the processing procedure shown in the flow chart of FIG. 9 using the function of the image signal generating section 402. At this time, the control section 40 specifies the frame number of the frame image being output. In the case that the control section 40 can specify that the frame number is "N2−1" on the basis of the stored calibration information 411, the control section 40 judges that the present time is the output timing of the calibration image, inserts the calibration image having a ½ frame time (0.017 sec) ahead of the frame image with the next frame number "N2" and outputs the calibration image as a new image signal.

In the example shown in FIG. 18, a cut point is detected in the frame image with frame number "N3". Hence, the frame image with frame number "N3−1" is set as a calibration image production target. In the frame image with frame number "N3−1", many regions thereof are occupied by "light gray" and the control section 40 judges that a calibration image with pixels having RGB values of (170, 170, 170) can be produced. The frame number "N3−1" is stored in the correction information 411. When an image signal is generated and when the frame number of the frame image being output is "N3−1", the control section 40 inserts the calibration image having a ½ frame time (0.017 sec) ahead of the frame image with the next frame number "N3" and outputs the calibration image.

Figure 19:
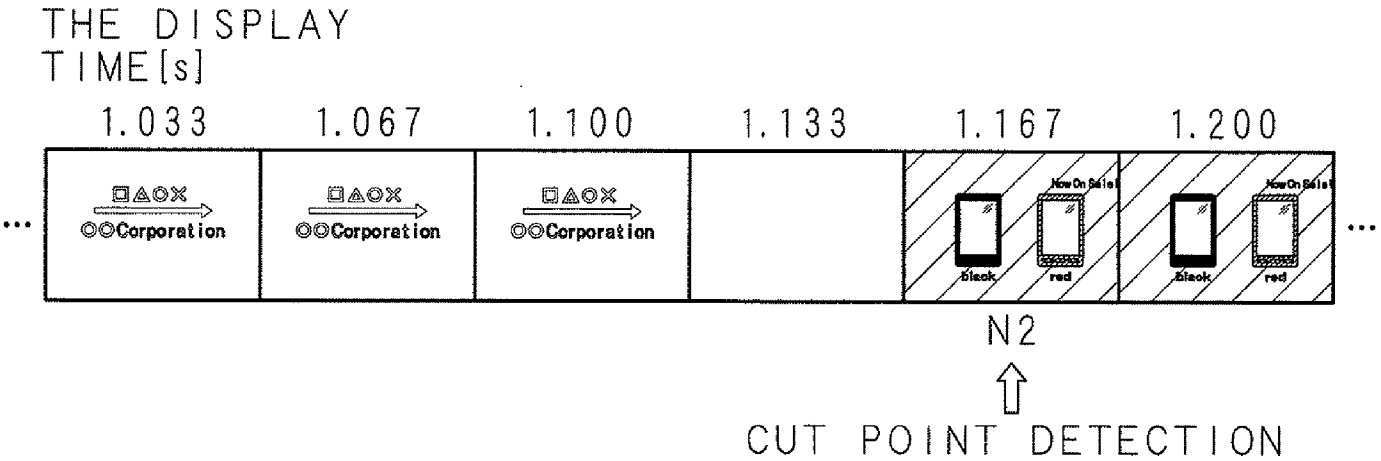
FIG. 19 is an explanatory view schematically showing an example of an image signal generated by the image signal generating section according to Embodiment 3.
Figure 20:
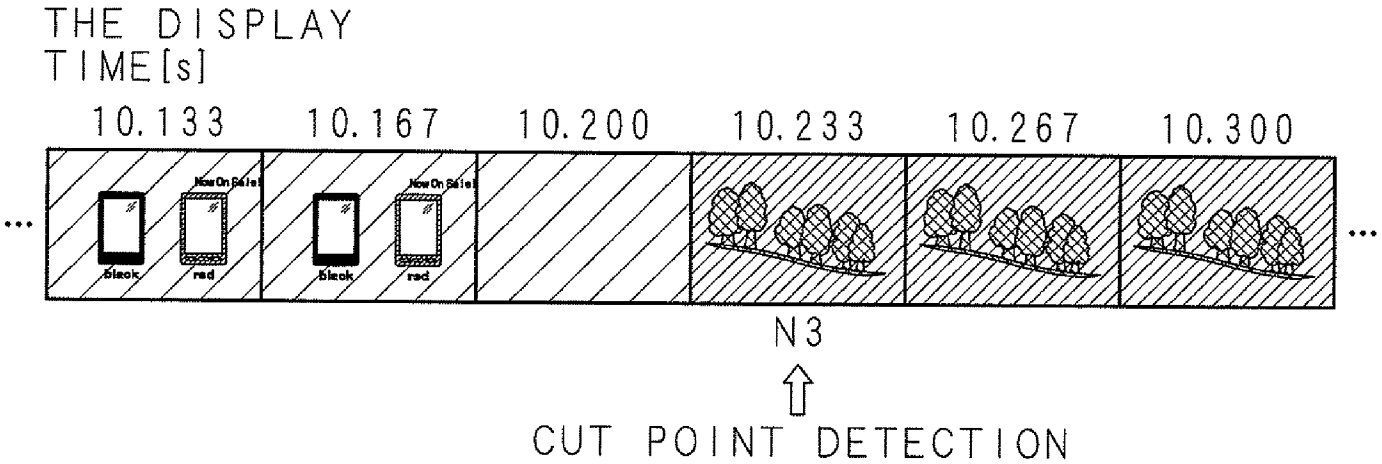
FIG. 20 is an explanatory view schematically showing an example of an image signal generated by the image signal generating section according to Embodiment 3.

FIGS. 19 and 20 show a case in which a frame image is replaced with a calibration image, the frame images ahead of and behind the calibration image being shown in time sequence.

In the example shown in FIG. 19, a cut point is detected in the frame image with frame number "N2" between the frame image and the preceding frame image. Hence, the frame image with frame number "N2−1" is set as a calibration image production target, and a calibration image with pixels having RGB values of (255, 255, 255) is produced. The frame number "N2−1" is stored in the correction information 411. When an image signal is generated and when the frame image to be output has frame number "N2", the control section 40 replaces the frame image with the "white" calibration image and outputs the calibration image.

In the example shown in FIG. 20, a cut point is detected in the frame image with frame number "N3" between the frame image and the preceding frame image. Hence, the frame image with frame number "N3−1" is set as a calibration image production target, and a calibration image with pixels having RGB values of (170, 170, 170) is produced. The frame number "N3−1" is stored in the correction information 411. When an image signal is generated and when the frame image to be output has frame number "N3", the control section 40 replaces the frame image with the "light gray" calibration image and outputs the calibration image.

As shown in FIGS. 17 to 20, the backgrounds of the calibration image and the preceding frame image have almost identical luminance or color. In addition, the calibration image is displayed when the cut point is detected, that is, when a scene change occurs. Hence, even when the calibration image is displayed, the viewer is far less likely to have uncomfortable feeling.

Embodiment 4

In Embodiment 4, when a calibration image is output, it is output continuously a plurality of times.

The configuration of the display system according to Embodiment 4 is similar to that according to Embodiment 1, except for the following processing procedure performed by the control section 40 of the control device 4. Hence, the commonly used components are designated by the same numerals and their detailed descriptions are omitted.

Figure 21:
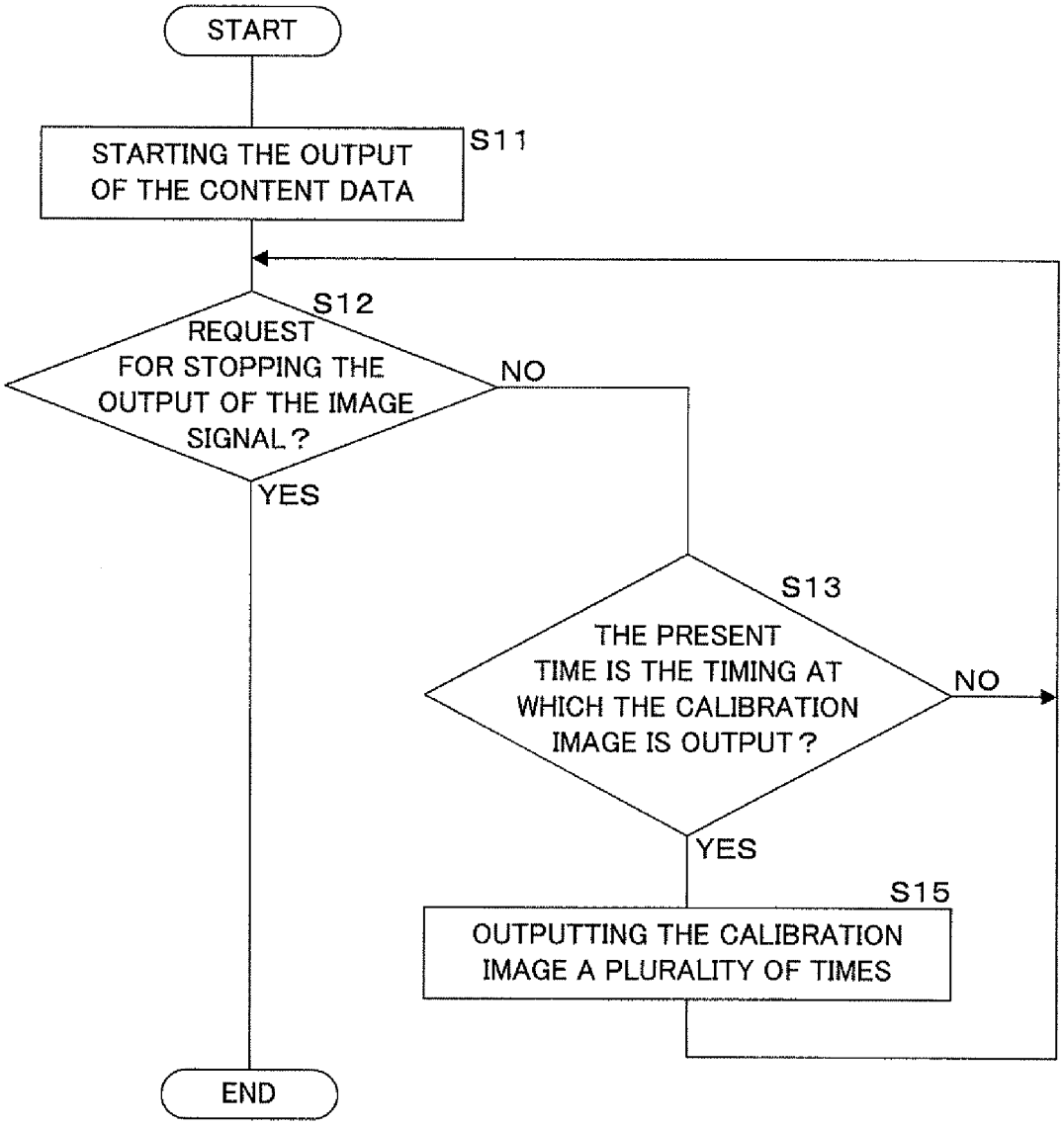
FIG. 21 is a flow chart showing an example of an image signal generating processing procedure according to Embodiment 4.

FIG. 21 is a flow chart showing an example of an image signal generating processing procedure according to Embodiment 4. In the following processing procedure, the same steps as those shown in the flow chart shown in FIG. 9 according to Embodiment 1 are designated by the same step numbers, and their detailed descriptions are omitted.

The control section 40 reads the content data from the storage device 5 and starts the output of the content data to the signal processing device 2 (at step S11), judges whether control-use data requesting for stopping the output of the image signal is input from the signal processing device 2 (at S12), and repeats the following process until the control section 40 judges that the control-use data requesting the output stop of the above-mentioned image signal is input.

Using the function of the image signal generating section 402, the control section 40 judges whether the present time is the timing at which a calibration image is output (at step S13). In the case that the control section 40 judges that the present time is the timing at which the calibration image is output (YES at S13), the control section 40 inserts the calibration image corresponding to the frame number or uses the calibration image for replacement a plurality of times on the basis of the calibration information 411 using the function of the image signal generating section 402 and outputs the calibration image (at step S15).

After outputting the calibration image, the control section 40 returns the process to step S12. In the case that the control section 40 judges that the present time is not the timing at which the calibration image is output (NO at S13), the control section 40 returns the process to step S12.

Figure 22:
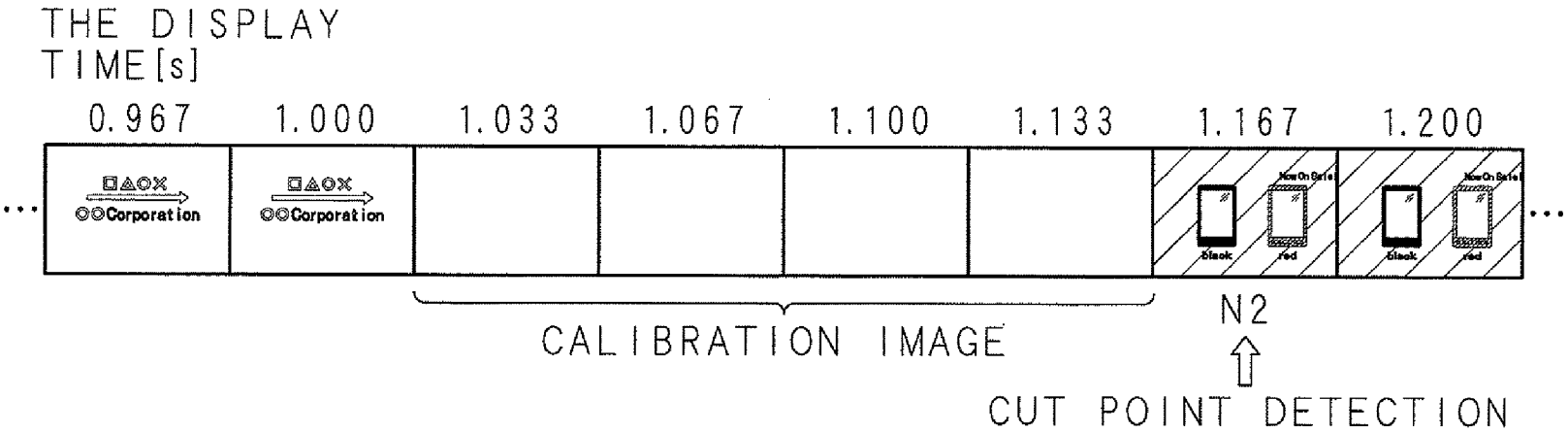
FIG. 22 is an explanatory view schematically showing an example of an image signal generated by an image signal generating section according to Embodiment 4.
Figure 23:
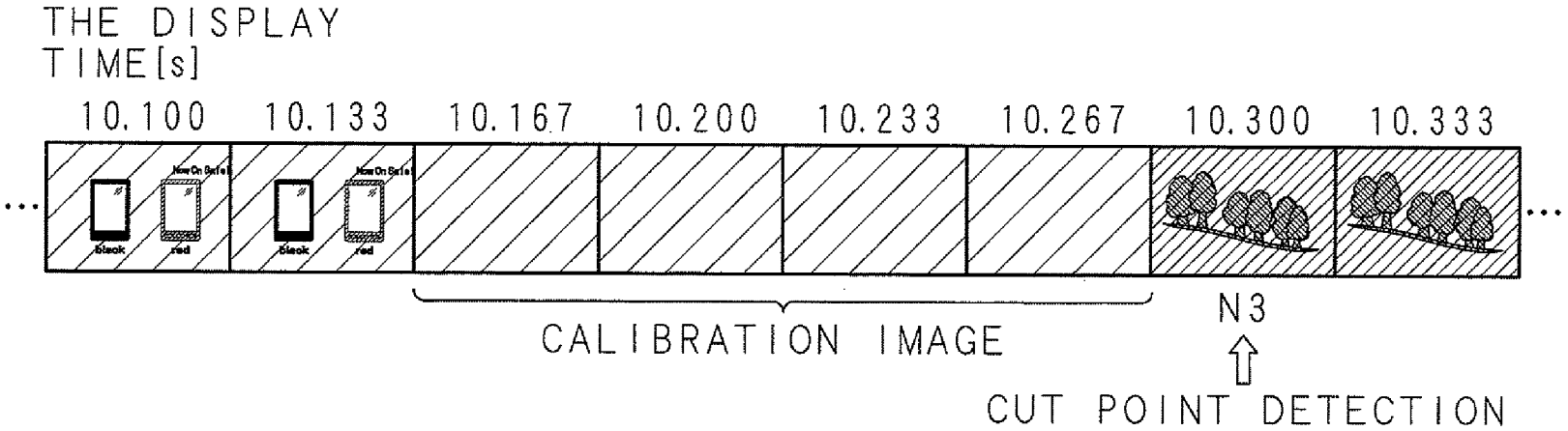
FIG. 23 is an explanatory view schematically showing an example of an image signal generated by the image signal generating section according to Embodiment 4.

FIGS. 22 and 23 are explanatory views schematically showing examples of image signals generated by the image signal generating section 402 according to Embodiment 4. FIGS. 22 and 23 show frame images based on the image signals in time sequence. The frame rate is 30 frames/sec, and the display time (the time elapsed from the first frame image) of each frame image is indicated in seconds [s].

In FIG. 22, a cut point is detected in the frame image with frame number "N2" between the frame image and the preceding frame image. Hence, the frame image with frame number "N2−1" is set as a calibration image production target, and a calibration image with pixels having RGB values of (255, 255, 255) is produced. The frame number "N2−1" is stored in the correction information 411. When an image signal is generated and in the case that the frame image being output has the stored frame number "N2−1", the control section 40 outputs the produced calibration image continuously a plurality of times (four times in FIG. 22). As a result, as shown in FIG. 22, the calibration image is displayed for a four-frame time between the frame image with frame number "N2−1" and the frame image with frame number "N2" in the original content data.

In FIG. 23, a cut point is detected in the frame image with frame number "N3" between the frame image and the preceding frame image. Hence, the frame image with frame number "N3−1" is set as a calibration image production target, and a calibration image with pixels having RGB values of (170, 170, 170) is produced. The frame number "N3−1" is stored in the correction information 411. When an image signal is generated and in the case that the frame image being output has the stored frame number "N3−1", the control section 40 outputs the produced calibration image continuously a plurality of times. As a result, as shown in FIG. 23, the calibration image is displayed for a four-frame time between the frame image with frame number "N3−1" and the frame image with frame number "N3" in the original content data.

As described above, since the calibration image produced so as to have the same luminance or color is output continuously, a time allowance is provided for the capturing timing controlled by the timing specifying section 403. In the case that the calibration image is output continuously a plurality of times, the timing specifying section 403 sets the time when the head calibration image is displayed as the display time and specifies the timing of the display. In the case that the calibration image is output continuously at 30 frames/sec four times, the calibration image is displayed for a four-frame time (0.133 sec). Hence, even if there is a delay until capturing is performed, the calibration image can be captured more securely.

Figure 24:
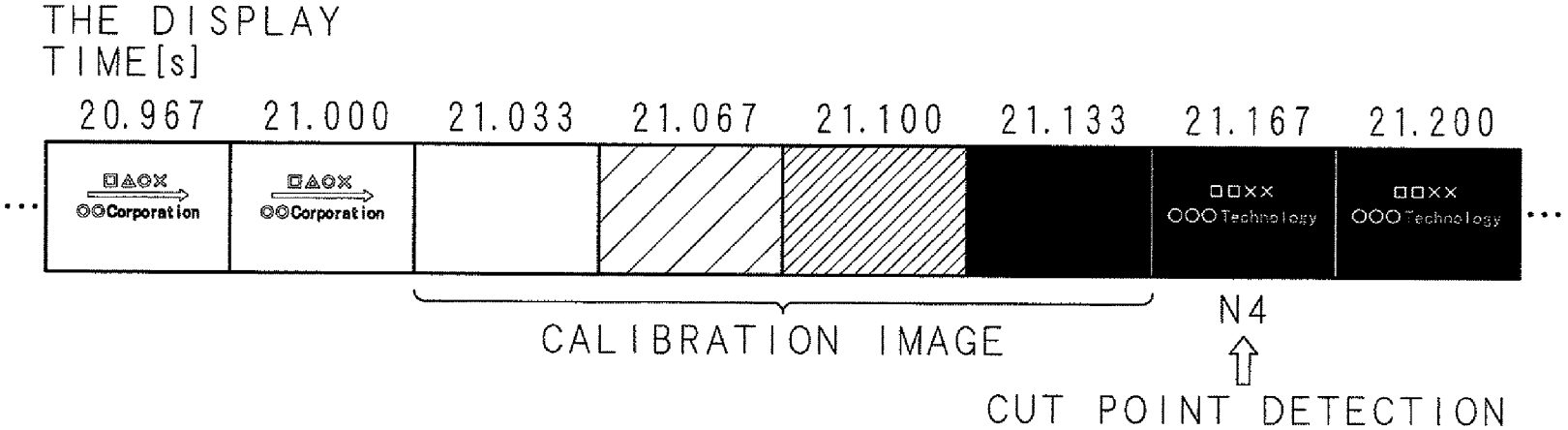
FIG. 24 is an explanatory view schematically showing another example of an image signal generated by the image signal generating section according to Embodiment 4.

When the calibration image corresponding to the frame number is inserted or used for replacement a plurality of times on the basis of the calibration information 411 using the function of the image signal generating section 402, the plurality of calibration images may be inserted while the luminance is changed. FIG. 24 is an explanatory view schematically showing another example of an image signal generated by the image signal generating section 402 according to Embodiment 4. FIG. 24 also shows frame images based on the image signal in time sequence. The frame rate is 30 frames/sec, and the display time (the time elapsed from the first frame image) of each frame image is indicated in seconds [s].

In FIG. 24, a cut point is detected in the frame image with frame number "N4" between the frame image and the preceding frame image. Using the function of the calibration image producing section 401, the control section 40 sets not only the frame image preceding the frame image have been set as the cut point detection target, that is, the frame image with frame number "N4−1", but also the frame image have been set as the cut point detection target, that is, the frame image with frame number "N4", as calibration image production targets, and judges that a calibration image with pixels having RGB values of (255, 255, 255) and a calibration image with pixels having RGB values of (0, 0, 0) can be produced.

Frame numbers "N4−1" and "N4" are stored in the calibration information 411. When an image signal is generated, in the case that the frame image being output has the stored frame number "N4−1", the next frame image has the frame number "N4", and two calibration images respectively corresponding to these two frame images are different in luminance or color, the control section 40 continuously outputs calibration images in which the luminance or color is changed gradually between the luminance or color levels of the two calibration images. As a result, as shown in FIG. 24, calibration images having different luminance levels are displayed continuously between the frame image with frame number "N4−1" and the frame image with frame number "N4" in the original content data.

Even when the calibration images having different luminance levels being changed gradually are output continuously as described above, the viewer does not have uncomfortable feeling.

As described above, correction can be made by using the content to be used to actually perform display on the display section 1 of the display system, by performing calibration while the image based on the content data is displayed, and by specifying a correction amount. The reproduction of the content is not required to be stopped for the calibration. In particular, in a display system for use in digital signage or the like, in which the content is required to be output at all times, the embodiment according to the present invention has an excellent effect in that luminance or color can be calibrated without losing the function of digital signage.

Embodiment 5

The configuration of the display system according to Embodiment 5 is similar to that according to Embodiment 1, except for the detailed content of the functions achieved by the control device 4. Hence, the commonly used components are designated by the same numerals and their detailed descriptions are omitted.

Figure 25:
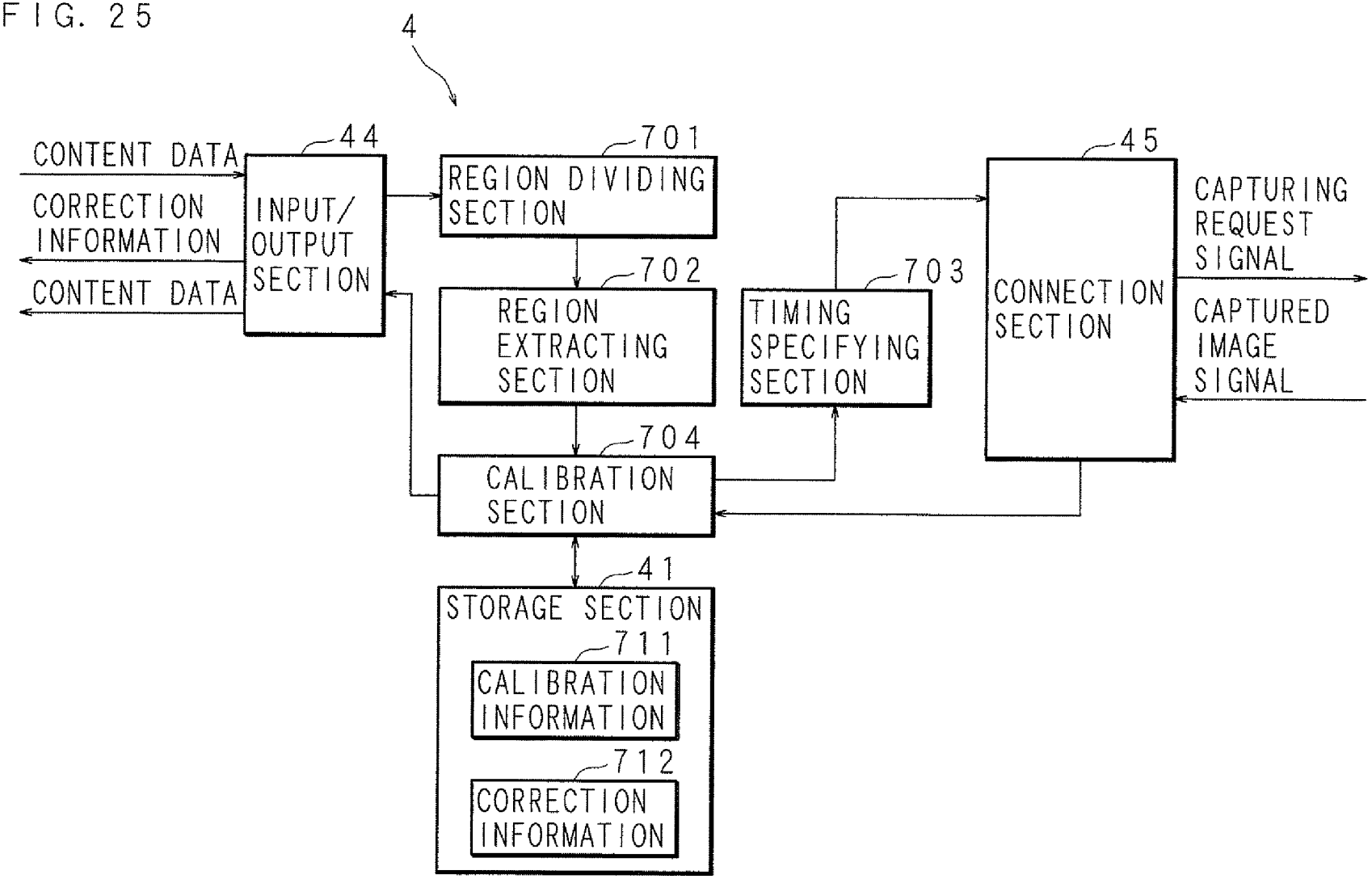
FIG. 25 is a functional block diagram showing the functions achieved by a control device according to Embodiment 5.

FIG. 25 is a functional block diagram showing the functions achieved by the control device 4 according to Embodiment 5. The control section 40 of the control device 4 reads and executes the control programs 4P stored in the storage section 41, thereby functioning as a region dividing section 701, a region extracting section 702, a timing specifying section 703 and a correction section 704, causing a personal computer to operate as the control device 4 of the display system, and performing various processes described below to carry out calibration. The region dividing section 701, the region extracting section 702, the timing specifying section 703, and the correction section 704 may be implemented in hardware as an integrated circuit.

The region dividing section 701 obtains an image from the content data read by the control section 40 and divides the image into blocks on the basis of the arrangement information on the display devices in the multiple display system 10. In the case that the content is a moving image, the region dividing section 701 obtains the image in frame unit and divides each frame image on the basis of the arrangement information. Furthermore, the region dividing section 701 specifies which block image corresponds to which display device of the multiple display system 10 and performs division. In other words, the region dividing section 701 divides the image so as to be displayed actually on the display device of the multiple display system 10, and specifies which block image belongs to which display device using another function described later. The control section 40 may obtain the arrangement information from the signal processing device 2 and store the arrangement information in the storage section 41 beforehand or the region dividing section 701 may obtain the arrangement information from the signal processing device 2.

The region extracting section 702 extracts calibration regions having uniform luminance or color from a plurality of divided block images output from the region dividing section 701 to perform calibration for the luminance or color to be displayed. The region extracting section 702 perform the extraction of the calibration regions with respect to a plurality of luminance or color levels. For example, the region extracting section 702 divides luminance into a plurality of levels, such as four levels, 10 levels or 18 levels, from luminance 0 (zero) to the maximum luminance and extracts regions including pixels matching to the respective luminance levels from a plurality of frame images. For example, in the case that the maximum luminance is represented by (255, 255, 255) and luminance is divided into four levels, the region extracting section 702 extracts calibration regions respectively having four levels (0, 0, 0), (85, 85, 85), (170, 170, 170) and (255, 255, 255) as RGB values. In the case that the maximum luminance is represented by (255, 255, 255) and luminance is divided into 18 levels, the region extracting section 702 extracts calibration regions respectively having 18 levels (0, 0, 0), (15, 15, 15), . . . , (240, 240, 240) and (255, 255, 255) as RGB values. Furthermore, the region extracting section 702 extracts, for example, pixels matching respectively to 18 different colors from a plurality of frame images. For example, the region extracting section 702 extracts calibration regions respectively having red (255, 0, 0), green (0, 255, 0), (0, 0, 255), and (255, 255, 255) as RGB values.

The region extracting section 702 stores, in the storage section 41, calibration information 711 including the frame number specifying the frame image from which the calibration regions are extracted, information on the extracted luminance or color levels, and the coordinate information on the calibration regions in the frame image or in the block images. In the coordinate information, for example, the horizontal direction of the block image or the frame image is represented by the x-axis and the vertical direction thereof is represented by the y-axis, and the most upper left pixel is used as the origin (0.0), and one pixel is represented as one unit. The coordinate information may be represented by other methods.

When calibration is actually performed on the basis of the stored calibration information 711, in the case that the content data to be used for calibration is output, the timing specifying section 703 calculates the time (the time elapsed from the start of image display on the basis of the content data) when the frame image including the calibration regions is displayed. The display time can be calculated as described below, for example.

$$\text{Display time} = \text{frame number} \times \text{frame rate of content}$$

The frame number is the frame number of the frame image including the calibration regions specified by the calibration information 711 stored in the storage section 41. When the content data to be used for calibration is output from the control section 40 to the signal processing device 2, the timing specifying section 703 outputs, to the capturing device 3, a signal indicating that the content data has been output, activates the capturing device 3, and then outputs a capturing request signal at the time point at which capturing should be performed on the basis of the calculated time. Hence, the timing specifying section 703 controls the timing of capturing so that the image including the calibration regions is captured by the capturing device 3.

With respect to the control of the synchronization between the timing at which the image including the calibration regions is displayed and the capturing timing of the capturing device 3, it is preferable that the timing specifying section 703 should measure a delay time relating to the transmission delay and measurement (capturing process) delay in the input/output section 44 and the connection section 45 and in the input/output section 22 of the signal processing device 2 and then should output a capturing request signal in consideration of the delay time. Furthermore, the timing specifying section 703 may be configured so as to output the capturing request signal without considering the delay time by using the capturing device 3 that can use a shutter having a very short delay time (for example, 1/10 or less of the frame rate) in comparison with the frame rate of the content data.

When the output of the content data to be used for the calibration is started by the process of the control section 40, the calibration section 704 performs a calibration process on the basis of the stored calibration information 711. When the output of the content data is started, the calibration section 704 receives the image signal of the image captured under the control of the timing specifying section 703 through the connection section 45. The calibration section 704 compares the captured image based on the received image signal with the calibration region of the corresponding frame image. The calibration section 704 extracts a region corresponding to the calibration region from the captured image, calculates the measurement value of the luminance or color of the region, compares the measurement value the luminance or color value of the calibration region, calculates a correction amount depending on the result of the comparison, and corrects the image signal.

It may be possible that the calibration section 704 obtains an input-output characteristic from the relationship between the measurement value and the luminance or color value of the calibration regions as a correction amount for each display device of the multiple display system 10, stores the correction amount as correction information 712 and outputs the correction amount to the signal processing device 2. Furthermore, at the image processing section 23 of the signal processing device 2, on the basis of the correction information 712 corresponding to each display device 10, correction may be performed for the image signal of the content data to be input. The signal processing device 2 can correct the RGB values of various image signals to be input by generally using the correction information 712 obtained from the calibration section 704.

Figure 26:
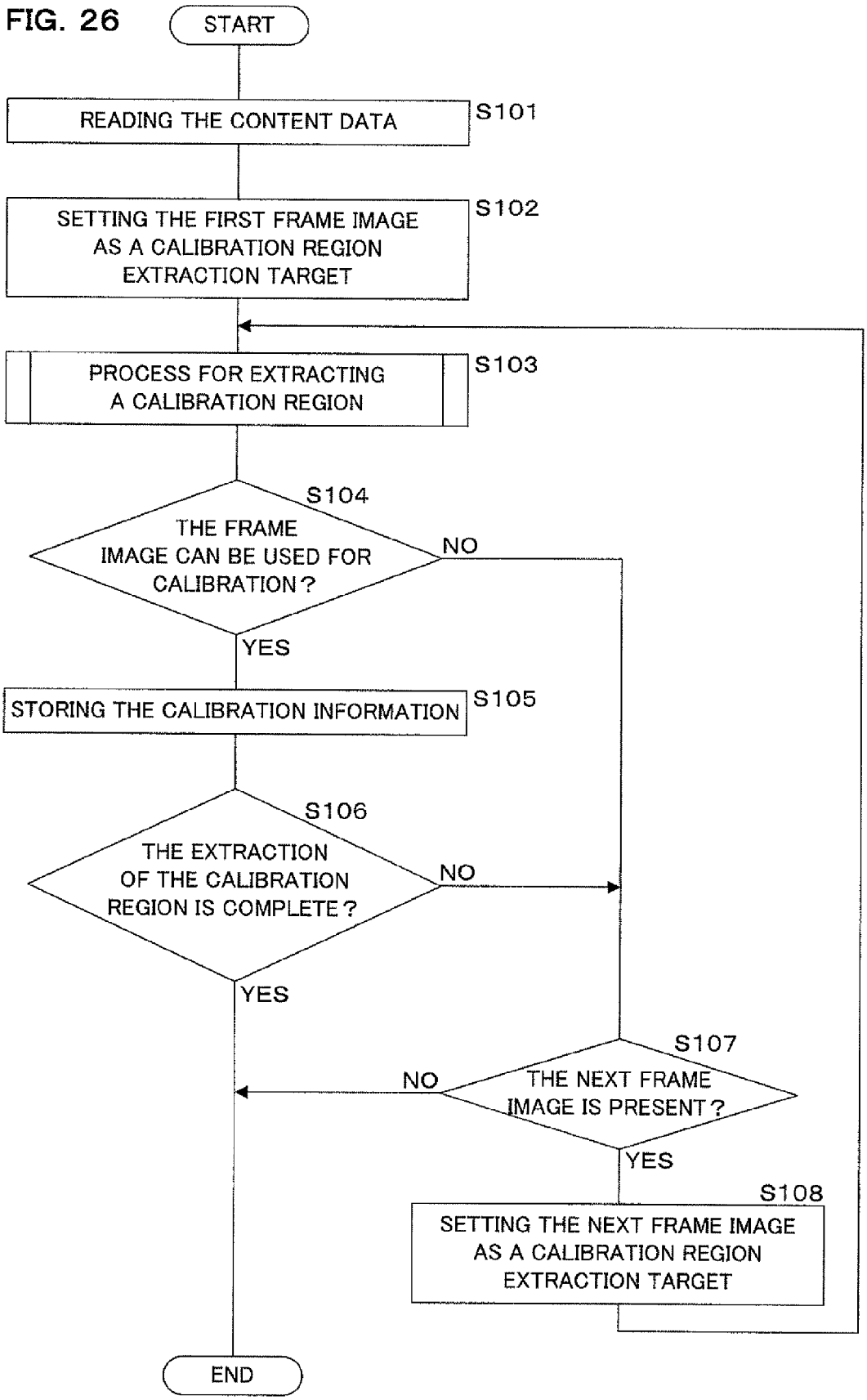
FIG. 26 is a flow chart showing an example of a processing procedure executed by the region dividing section and the region extracting section of the control device.

In the display system configured as described above, a procedure in which the luminance or color in the display section 1 is calibrated will be described in detail sequentially. FIG. 26 is a flow chart showing an example of a processing procedure performed by the region dividing section 701 and the region extracting section 702 of the control device 4. Using the region dividing section 701 and the region extracting section 702, the control section 40 of the control device 4 performs respective processes beforehand according to the following procedure before performing calibration using the content data read from the storage device 5. The content data in the process described below is a moving image.

The control section 40 reads the content data from the storage device 5 through the input/output section 44 (at step S101), and sets the first frame image (frame number 0 (zero) as a calibration region extraction target (at step S102). More specifically, the control section 40 assigns 0 (zero) to the frame number of the frame image serving as the extraction target.

The control section 40 performs a process for extracting a calibration region from the frame image serving as the extraction target (at step S103). As the result of the extraction process, the control section 40 judges whether the frame image can be used for calibration (at step S104). More specifically, the control section 40 judges whether the calibration region can be extracted from the frame image. In the case that the control section 40 judges that the calibration region can be used for calibration (YES at S104), the control section 40 stores the calibration information 711 in the storage section 41 (at step S105) and judges whether the extraction of the calibration region with respect to all the predetermined luminance or color levels is completed (at step S106). In the case that the control section 40 judges that the extraction of the calibration region with respect to all the predetermined luminance or color levels is completed (YES at S106), the control section 40 ends the process.

In the case that the control section 40 judges at step S104 that the calibration region cannot be used for calibration (NO at S104) and in the case that the control section 40 judges that the extraction of the calibration region with respect to all the predetermined luminance or color levels is not completed (NO at S106), the control section 40 judges whether the next frame image is present (at step S107). In the case that the control section 40 judges that the next frame image is present (YES at S107), the control section 40 sets the next frame image as a calibration region extraction target (at step S108) and returns the process to step S103. In the case that the control section 40 judges that no next frame image is present (NO at step S107), the control section 40 ends the process.

Figure 27:
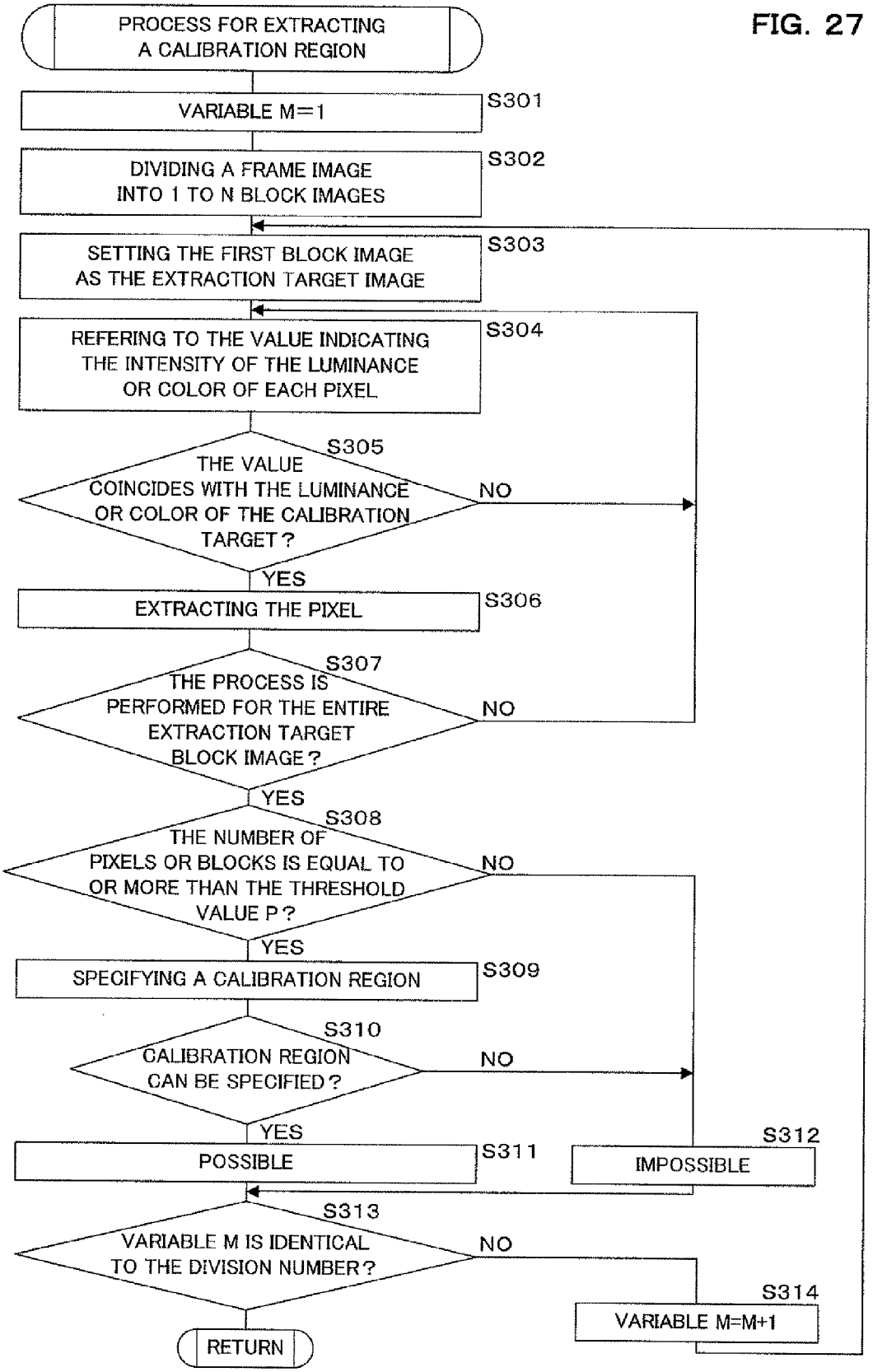
FIG. 27 is a flow chart showing an example of the detailed processing procedure of the calibration region extracting process at step S103 shown in FIG. 26.

FIG. 27 is a flow chart showing an example of the detailed processing procedure of the calibration region extracting process at step S103 shown in FIG. 26.

The control section 40 assigns 1 to the counting variable M (at step S301). Using the function of the region dividing section 701, the control section 40 divides a frame image into 1 to N block images on the basis of the arrangement information on the display devices in the multiple display system 10 (at step S302).

Figure 28:
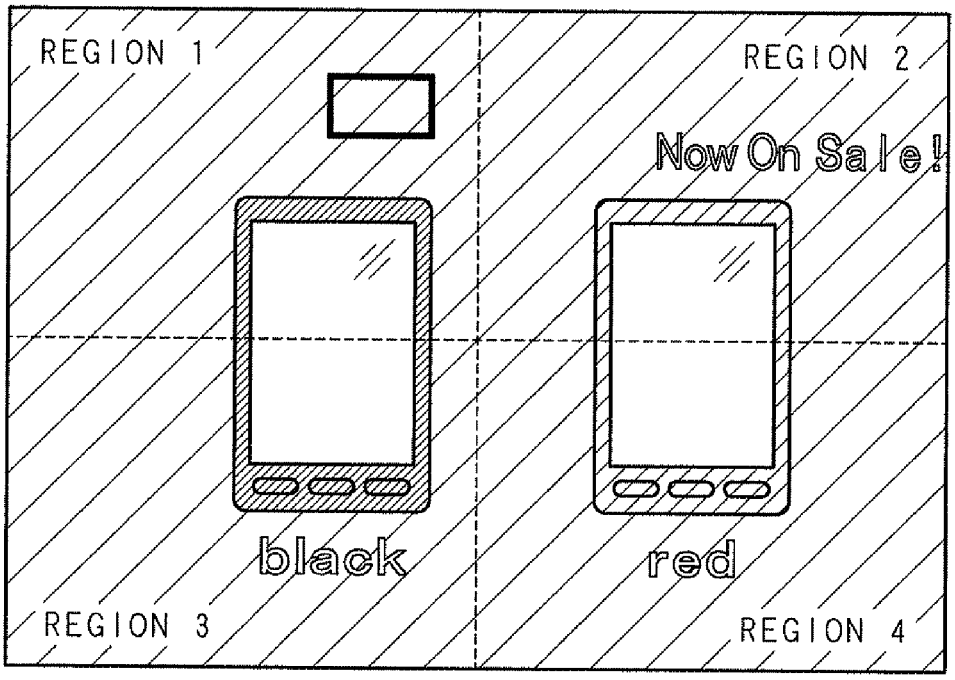
FIG. 28 is an explanatory view showing an example of a frame image to be divided by the region dividing section.

FIG. 28 is an explanatory view showing an example of a frame image to be divided by the region dividing section 701. In the case that the regions of the frame image are arranged in two rows and two columns as in Embodiment 5, the region dividing section 701 divides the image into four block images (N=4) as indicated by broken lines in FIG. 28, and these block images are respectively specified as a region 1 (upper left), a region 2 (upper right), a region 3 (lower left), and a region 4 (lower right). More specifically, the region dividing section 701 specifies the region corresponding to the display device 10 located at (0, 0) in the 0th row and the 0th column as the region 1 and also specifies the region corresponding to the display device 10 located at (1, 1) in the 1st row and the 1st column as the region 4.

The description continues, returning to the flow chart shown in FIG. 27.

Next, the control section 40 sets the first block image (number 1) as the extraction target image in the calibration region (at step S303). More specifically, the control section 40 assigns the number of the block image, that is, the number 1 of the region, to the number of the extraction target image in the calibration region.

The control section 40 sequentially scans the pixels of the extraction target block image and sequentially refers to the value indicating the intensity of the luminance or color of each pixel using the region extracting section 702 (at step S304), and then judges whether the value coincides with the luminance or color of the calibration target within an allowable range (at step S305).

More specifically, in the case that, for example, the colors of the pixels of the image obtained from the content data are represented by gradation values indicating the intensity of RGB (R: red, G: green, B: blue), when it is assumed that the RGB values of the calibration target are (Rc, Gc, Bc), the control section 40 judges that the following three expressions are satisfied with respect to the color of each pixel using the function of the region extracting section 702.

$$Rc-\delta_R \leq R \leq Rc+\delta_R$$

$$Gc-\delta_G \leq G \leq Gc+\delta_G$$

$$Bc-\delta_B \leq B \leq Bc+\delta_B$$

At this time, it is assumed that the guide values of $\delta_R$, $\delta_G$ and $\delta_B$ are respectively approximately 1/32 of the maximum values of the RGB values. For example, in the case that the RGB values are respectively represented by 8-bit digital signals, the values of $\delta_R$, $\delta_G$ and $\delta_B$ become "8" because the RGB values are in the range of 0 to 255. The values of $\delta_R$, $\delta_G$ and $\delta_B$ should be set appropriately; for example, they should be set to small values in the case that luminance steps are set minutely.

Furthermore, at step S304, in order that an image having many edges is not used for calibration, instead of referring to all the pixels one by one and making a judgment as to whether the luminance or color of each pixel coincides with specific luminance or color, the region extracting section 702 may refer to each block formed of a plurality of pixels, such as 3×3 pixels. At this time, the average value, the median value or the like may be calculated and used as the luminance or color of each block.

In the case that the control section 40 judges that the luminance or color of each pixel coincides with the specific luminance or color (YES at S305), the control section 40 extracts the pixel that is judged that the luminance or color thereof coincides with the specific luminance or color (at step S306) and then judges whether the process is performed for the entire extraction target block image (at step S307). In the case that the control section 40 judges that the process is not completed (NO at S307), the control section 40 returns the process to step S304 and perform the judgment process for the next pixel at step S305.

In the case that the control section 40 judges that the process has been performed for the entire extraction target block image (YES at step S307), the control section 40 judges whether the number of pixels having luminance or color, that is, the number of pixels having the RGB values (Rc, Gc, Bc), being coincident with the luminance or color of the calibration target is equal to or more than a predetermined threshold value p (at step S308). The threshold value p is a ratio, for example, 30%, or the number of pixels. In the case that the control section 40 judges that the pixels, the number of which is equal to or more than the threshold value p, has been able to be extracted (YES at S308), the control section 40 specifies a calibration region on the basis of the extracted pixels (at step S309).

Figure 29:
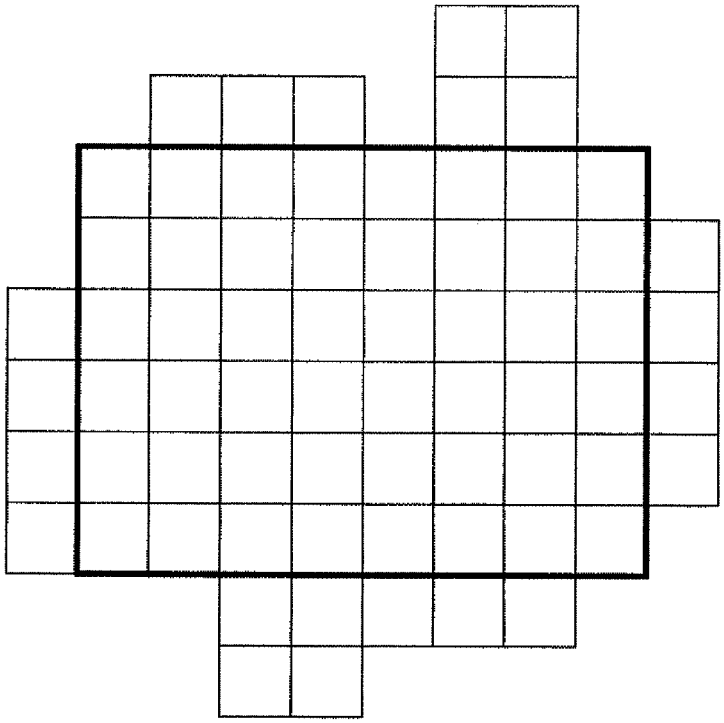
FIG. 29 is an explanatory view showing an example of a calibration region specified using the function of the region extracting section.

FIG. 29 is an explanatory view showing an example of a calibration region specified using the function of the region extracting section 702. The respective tile-shaped rectangles shown in FIG. 29 indicate pixels extracted as those having luminance or color, that is, those having the RGB values, being coincident with the luminance or color of the calibration target. The thick lines in FIG. 29 indicate a calibration region that is obtained by the following process and corresponds to the range enclosed by the thick lines inside the region 1 in FIG. 28. The region extracting section 702 specifies the circumscribed rectangle of the pixel group extracted in such an amoeba-like shape shown in FIG. 29 and tentatively sets the circumscribed rectangle as a calibration region. The region extracting section 702 judges whether the pixels around the outer circumference of the tentative calibration region are arranged continuously in the horizontal direction or in the vertical direction. In other words, the region extracting section 702 judges whether each outer circumferential line of the tentative calibration region is embedded with the extracted pixels. In the case that the pixels are not arranged continuously, the region extracting section 702 sets the inner line next to the outer circumferential line as the outer circumferential line of the tentative calibration region and makes a similar judgment for the outer circumferential line. In the case that the region extracting section 702 judges that the pixels are arranged continuously in all the outer circumferential lines in the horizontal direction or in the vertical direction, the region extracting section 702 determines and specifies the rectangular region (thick lines in FIG. 29) inside the outer circumferential lines as a calibration region.

The description continues, returning to the flow chart shown in FIG. 27.

Using the function of the region extracting section 702, the control section 40 judges whether a calibration region can be specified (at step S310). In the case that a calibration region can be specified (YES at S310), the control section 40 judges that the frame image can be used for calibration (at step S311) and advances the process to the next step.

In the case that the control section 40 judges that the pixels, the number of which is equal to or more than the threshold value p, cannot be extracted (NO at S308) and in the case that the control section 40 judges that no calibration region can be specified (NO at S310), the control section 40 judges that the frame image cannot be used for calibration (at step S312) and advances the process to the next step.

Next, using the function of the region extracting section 702, the control section 40 judges whether the counting variable M is identical to the division number (the number of the block images) of the frame image (at step S313). In other words, the control section 40 judges whether all the block images have been processed. In the case that the control section 40 judges that the counting variable M is identical to the division number of the frame image (YES at S313), the control section 40 ends the calibration region extraction process and returns the process to step S104 shown in FIG. 26.

In the case that the control section 40 judges that the counting variable M is different from the division number of the frame image and that all the block images have not been processed (NO at S313), the control section 40 adds 1 to the variable M (at step S314) and returns the process to step S303.

Hence, the content data for advertisement displayed on the display section 1 to deliver the function of digital signage can also be used for calibration.

The processing procedures shown in FIGS. 26 and 27 are described below using specific examples.

FIGS. 30 to 33 are explanatory views showing examples of frame images of content data, each frame image being divided into block images and a calibration region being extracted from each block image. In the case that 8-bit RGB values are divided into four monochrome levels (255, 255, 255), (170, 170, 170), (85, 85, 85), and (0, 0, 0), FIGS. 30 to 33 show examples in each of which calibration regions having the respective RGB values are extracted.

Figure 30:
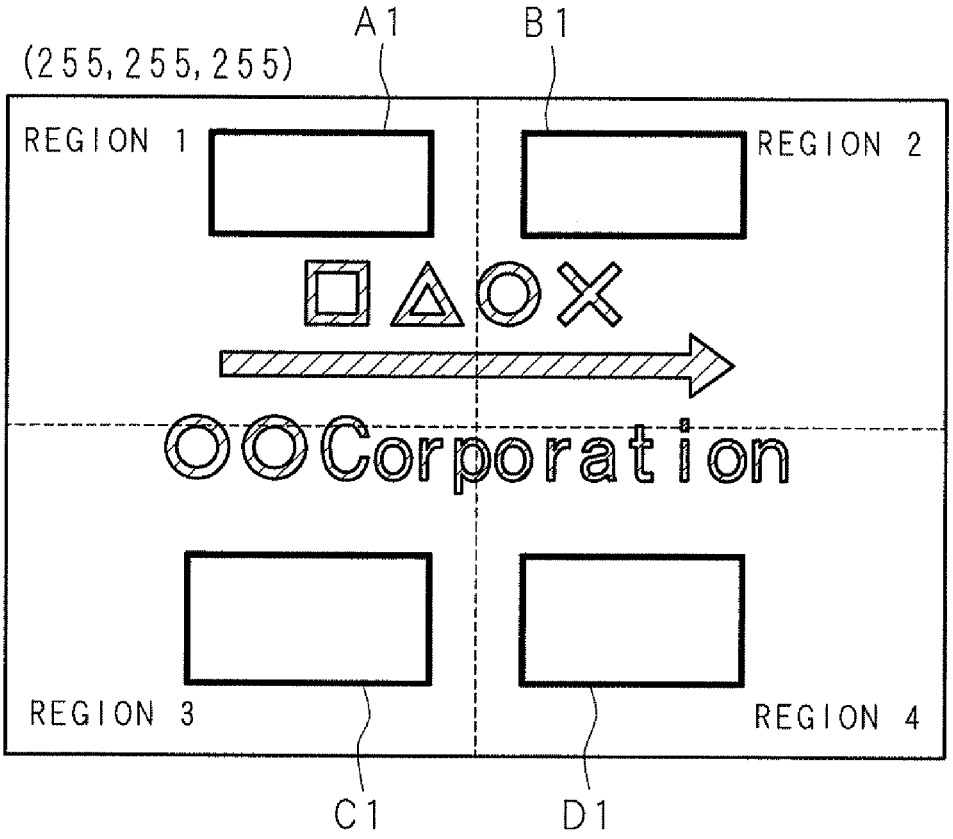
FIG. 30 is an explanatory view showing an example of a frame image of content data, the frame image being divided into block images and a calibration region being extracted from each block image.

The frame image shown as an example in FIG. 30 is an N1-th frame image inside the content for advertisement. This frame image is a frame image displaying the corporate statement of "oo Corporation" and "white" is used in the background. From the frame image, calibration regions with pixels having the RGB values of the maximum luminance (255, 255, 255) are extracted as described below.

Using the function of the region dividing section 701, the control section 40 of the control device 4 divides the frame image into block images having a region 1, a region 2, a region 3, and a region 4 so as to correspond to the arrangement of the display devices in the multiple display system 10 of the display section 1 as shown in FIG. 30 (see FIG. 1). Next, using the function of the region extracting section 702, the control section 40 first scans the pixels of the block image in the region 1 and judges that pixels having pixel values being coincident with (255, 255, 255) in the RGB values having four levels are present, extracts the pixels having pixel values of (255, 255, 255), and specifies a rectangular region from the extracted pixels. As a result, a region A1 inside the region 1 in FIG. 30 is extracted. The control section 40 stores the frame number "N1", the extracted RGB values of (255, 255, 255), and the coordinate information of the region A1 as the calibration information 711.

Similarly, the control section 40 extracts a region B1, a region C1, and a region D1 serving as calibration regions corresponding to the other display devices 10 from the respective block images of the region 2, the region 3, and the region 4, and stores the frame number "N1", the RGB values of (255, 255, 255), and the coordinate information of the region B1, the region C1, and the region D1 as the calibration information 711.

Figure 31:
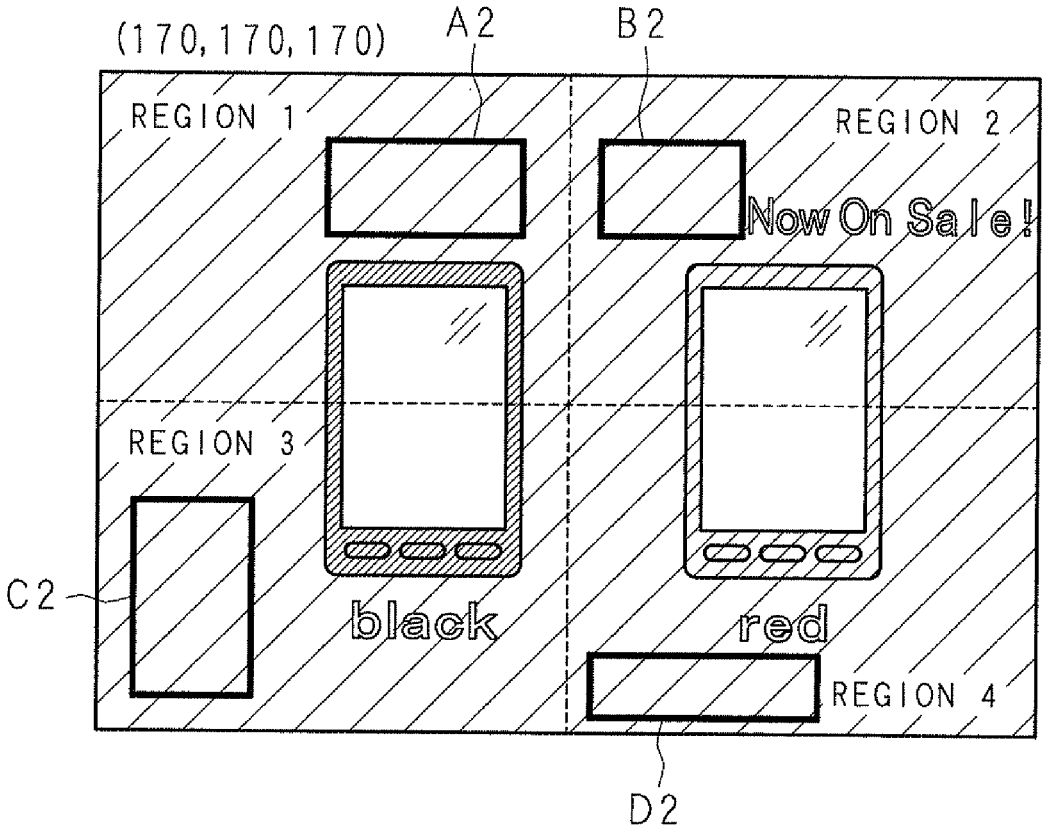
FIG. 31 is an explanatory view showing an example of a frame image of content data, the frame image being divided into block images and a calibration region being extracted from each block image.

The frame image shown in FIG. 31 as an example is an N2-th frame image in the same content as that of the example shown in FIG. 30. This frame image includes images of commercial products, and "light gray" is used in the background. From the frame image, calibration regions with pixels having the RGB values of (170, 170, 170) are extracted.

Also in the example shown in FIG. 31, the control section 40 of the control device 4 divides the frame image into block images having a region 1, a region 2, a region 3, and a region 4, and extracts pixels having pixel values being coincident with (170, 170, 170) in the RGB values having four levels from the respective block images. Then, using the function of the region extracting section 702, the control section 40 extracts a region A2, a region B2, a region C2, and a region D2 including the extracted group of pixels. Furthermore, the control section 40 stores the frame number "N2", the RGB values of (170, 170, 170), and the coordinate information of the region A2, the region B2, the region C2, and the region D2 as the calibration information 711.

Figure 32:
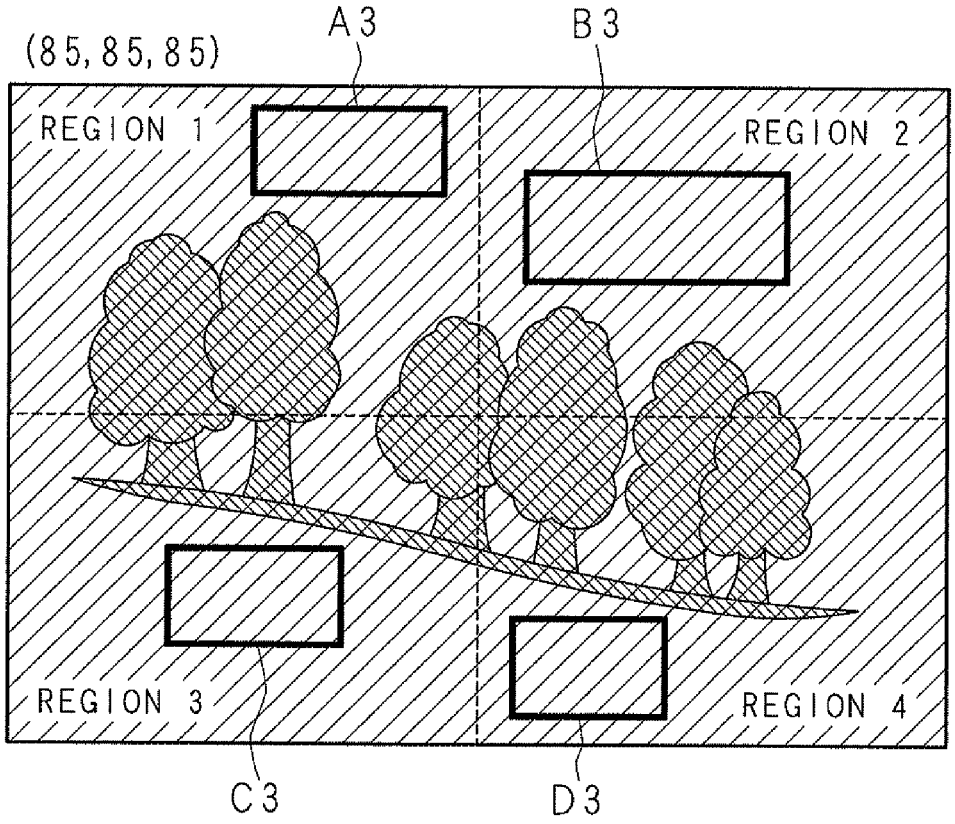
FIG. 32 is an explanatory view showing an example of a frame image of content data, the frame image being divided into block images and a calibration region being extracted from each block image.

The frame image shown in FIG. 32 as an example is an N3-th frame image in the same content as that of the example shown in FIG. 30. This frame image includes a landscape image representing the image of a commercial product or service, and "dark gray" is used in the background.

Similarly, also in the example shown in FIG. 32, the control section 40 of the control device 4 can divide the frame image into block images having a region 1, a region 2, a region 3, and a region 4, and can extract pixels having pixel values being coincident with (85, 85, 85) in the RGB values having four levels from the respective block images. Using the function of the region extracting section 702, the control section 40 extracts a region A3, a region B3, a region C3, and a region D3 including the extracted group of pixels. Furthermore, the control section 40 stores the frame number "N3", the RGB values of (85, 85, 85), and the coordinate information of the region A3, the region B3, the region C3, and the region D3 as the calibration information 711.

Figure 33:
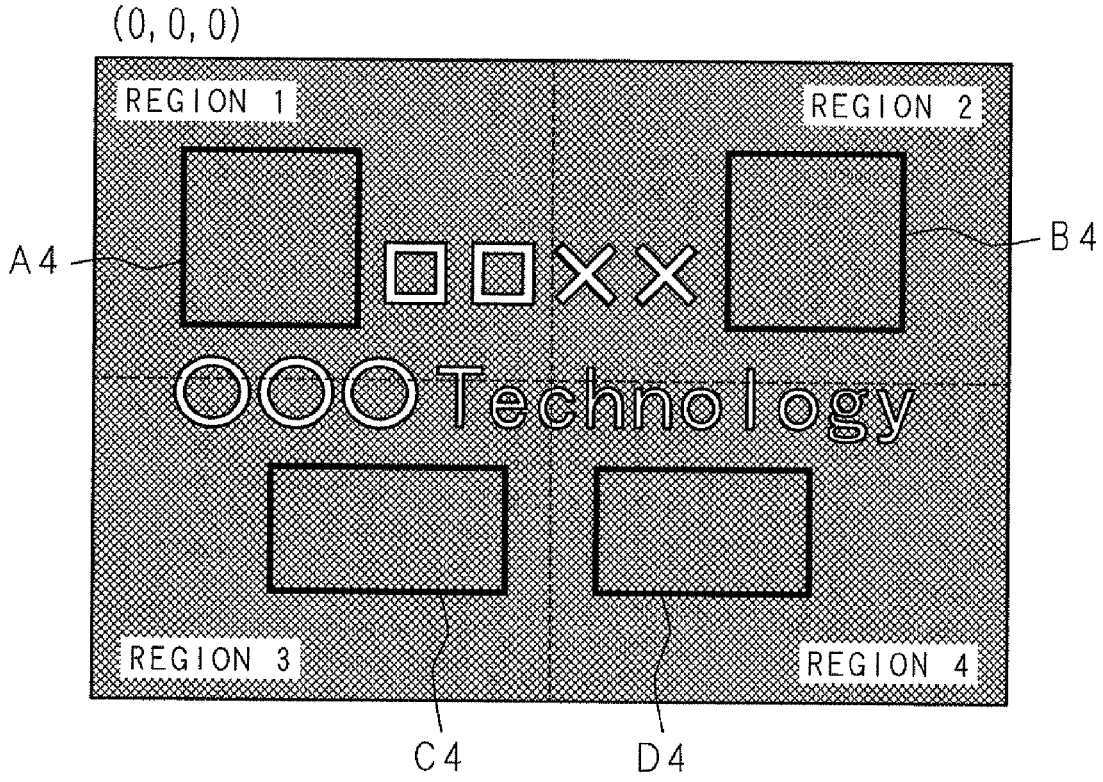
FIG. 33 is an explanatory view showing an example of a frame image of content data, the frame image being divided into block images and a calibration region being extracted from each block image.

The frame image shown in FIG. 33 as an example is an N4th frame image in the same content as that of the example shown in FIG. 30. This frame image is a frame image displaying the corporate statement of a corporation and "black" is used in the background. From the frame image, calibration regions with pixels having the RGB values of the minimum luminance (0, 0, 0) are extracted.

Similarly, also in the example shown in FIG. 33, the control section 40 of the control device 4 divides the frame image into block images having a region 1, a region 2, a region 3, and a region 4, and extracts pixels having pixel values being coincident with (0, 0, 0) in the RGB values having four levels from the respective block images, from which no calibration region is extracted. Furthermore, using the function of the region extracting section 702, the control section 40 extracts a region A4, a region B4, a region C4, and a region D4 including the extracted group of pixels. Moreover, the control section 40 stores the frame number "N4", the RGB values of (0, 0, 0), and the coordinate information of the region A4, the region B4, the region C4, and the region D4 as the calibration information 711.

As shown in FIGS. 30 to 33, instead of a color chart serving as a special standard for calibration, the images included the content for advertisement can be used as calibration images.

In the above-mentioned examples shown in FIGS. 30 to 33, the four block images corresponding to the arrangement information on the display devices in the multiple display system 10 are all extracted from each frame image, and the calibration regions having the same RGB values are extracted from each block image. However, the present invention is not limited to this, but it may be possible that only one, two, or three block images are extracted from one frame image and that the luminance or color levels of the calibration regions extracted from the respective block images are different from one another. However, for the regions 1 to 4 respectively corresponding to the same display devices 10, calibration regions having different luminance or color levels should be extracted from any given four frame images. In other words, for example, it may be possible that a calibration region with pixels having the RGB values of (255, 255, 255) is extracted from the region 1 of an Nx-th frame image and that a calibration region with pixels having the RGB values of (170, 170, 170) is extracted from the region 2 thereof.

Next, a procedure for performing calibration for the content data on the basis of the stored calibration information will be described by performing the processes shown in FIGS. 26 and 27.

Figure 34:
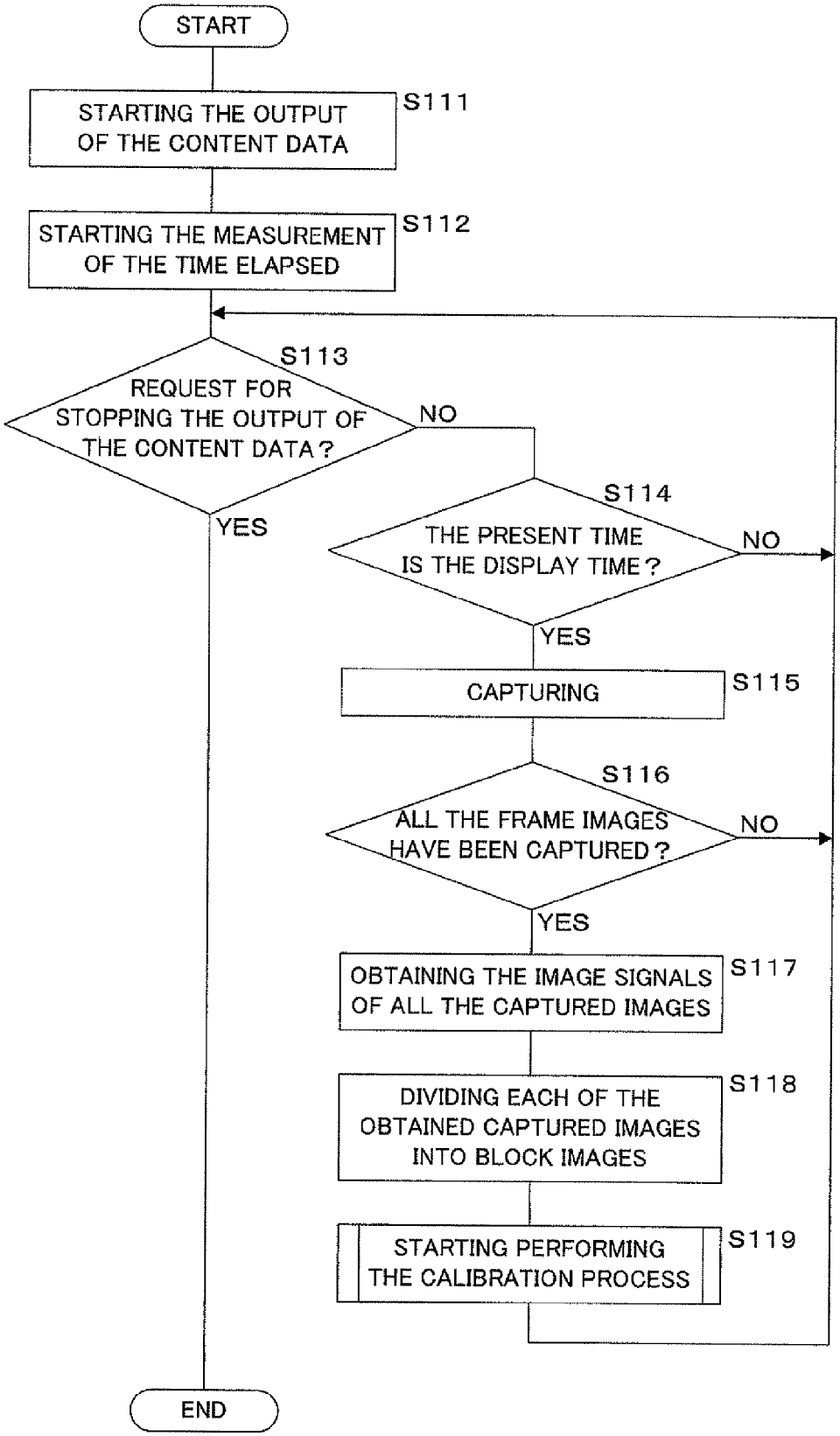
FIG. 34 is a flow chart showing an example of a processing procedure performed by the timing specifying section and the calibration section of the control device.

FIG. 34 is a flow chart showing an example of a processing procedure performed by the timing specifying section 703 and the calibration section 704 of the control device 4. In the case that the operator performed operation to instruct the reproduction of content through the operation section 25 of the signal processing device 2, the control section 20 receives a notice from the operation section 25 and recognizes it and then outputs control-use data requesting the output start of the content data to the control device 4. When the control section 40 of the control device 4 receives the control-use data requesting the output start of the content data from the input/output section 44, the control section 40 performs the following process.

The control section 40 reads the content data and starts the output of the content data to the signal processing device 2 via the input/output section 44 (at step S111). Hence, the reproduction of the content is started. The control section 40 keeps outputting the content data at an appropriate transmission rate so as to be in time with the output of the image signal from the signal processing device 2 and the display rate in the display section 1. The control section 40 then starts the measurement of the time elapsed from the start of the output of the content data (at step S112).

Next, the control section 40 judges whether the control-use data requesting for stopping the output of the content data is input from the signal processing device 2 (at step S113). In the case that the control section 40 judges that the control-use data requesting for stopping the output of the content data is input (YES at S113), the control section 40 ends the process for outputting the content data. The control-use data requesting the output stop of the content data is output from the signal processing device 2 to the control device 4 when the operator performed operation to instruct the output stop of the content data through the operation section 25 of the signal processing device 2 and when the control section 20 receives a notice from the operation section 25 and recognizes the notice.

In the case that the control section 40 judges that the above-mentioned control-use data requesting for stopping the output of the content data is not input (NO at S113), the control section 40 repeats the following process until the control-use data is input.

On the basis of the time elapsed from the start of the output of the content data and using the function of the timing specifying section 703, the control section 40 judges whether the present time is the display time of the frame image with a frame number included in the calibration information 711 (at step S114). In the case that the control section 40 judges that the present time is the display time (YES at S114), the control section 40 outputs an capturing request signal from the connection section 45 to the capturing device 3 and causes the capturing device 3 to perform capturing (at step S115). In the case that the control section 40 judges that the present time is not the display time (NO at S114), the control section 40 returns the process to step S113.

After causing the capturing device 3 to perform capturing, the control section 40 judges that all the frame images with frame numbers included in the stored calibration information 711 have been captured (at step S116). In the case that the control section 40 judges that all the frame images have not been captured (No at S116), the control section 40 returns the process to step S113. In the case that the control section 40 judges that all the frame images have been captured (YES at S116), the control section 40 obtains the image signals of all the captured images using the function of the calibration section 704 (at step S117). However, the control section 40 may obtain an image signal each time capturing is performed.

Using the function of the calibration section 704, the control section 40 divides each of the obtained captured image into block images according to the arrangement of the display devices in the multiple display system 10 (at step 118). Information for identifying each display device of the multiple display system 10 is related to each block image. Using the function of the calibration section 704 and on the basis of the divided block image, the control section 40 starts performing the calibration process for each display device 10 (at step S119) and returns the process to step S113. While the calibration process is performed, the output of the content data continues. After the calibration process is completed, the image signal of the content data to be output is corrected by the correction process (at steps S907 and S911 described later) performed by the calibration section 704 or by the correction process performed by the signal processing device 2 on the basis of correction information 712 to be output.

Figure 35:
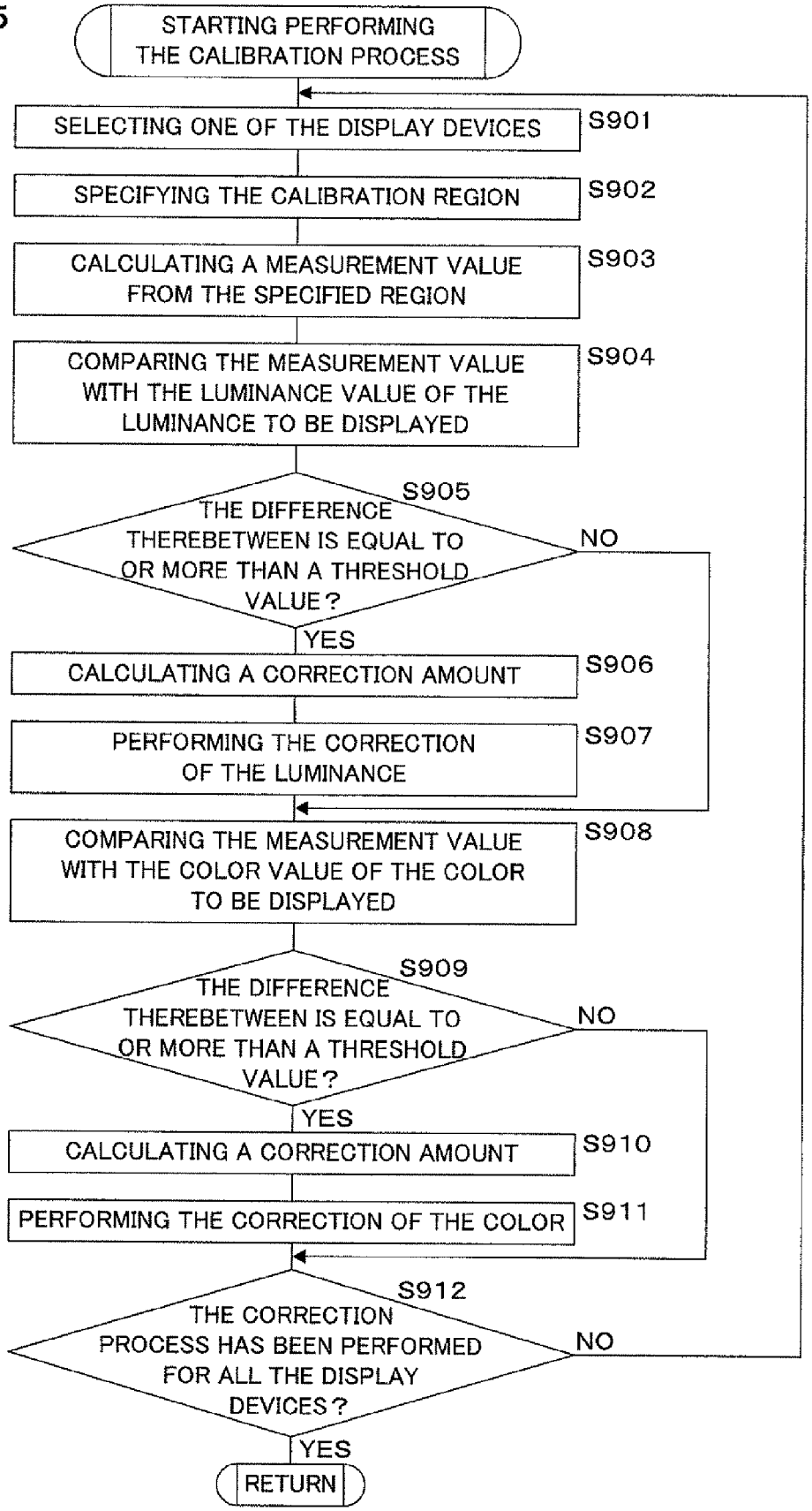
FIG. 35 is a flow chart showing an example of the detailed processing procedure of the calibration process at step S119 shown in FIG. 34.

FIG. 35 is a flow chart showing an example of the detailed processing procedure of the calibration process at step S119 shown in FIG. 34. The control section 40 performs the following process using the calibration section 704.

The control section 40 selects one of the display devices 10 (at step S901) and specifies, from the corresponding block image, a region in which the calibration region corresponding to the selected display device 10 is captured (at step S902).

More specifically, since the coordinate information of the calibration region is stored in the storage section 41 as the calibration information 711, the control section 40 specifies, on the basis of the information, a region corresponding to the calibration region at step S902. At this time, the control section 40 extracts a range in which an image is displayed in the display section 1 from the captured image, compares the number of pixels (the size in the horizontal and vertical directions) in the extracted range with the number of pixels in the frame image of the content data output to the signal processing device 2, and converts the position and size of the calibration region in the output frame image into the position and size in the range extracted from the captured image. The control section 40 extracts a region corresponding to the calibration region, the position and size of which have been converted in the range extracted from the captured image, specifies the position (upper left (0, 0), lower right (1, 1), etc.) of the display device 10 corresponding to the position in the captured image in which the region is present, whereby the control section 40 can specify a region in which the calibration region corresponding to the selected display device 10 has been captured.

Next, for each display device 10 located at the specified position, the control section 40 calculates a measurement value (luminance value or color value) from the region specified at step S902 by performing a predetermined arithmetic operation (at step S903). As the predetermined arithmetic operation, the control section 40 calculates, for example, the average value of the pixel values (RGB values) of the pixels in the region in which the calibration region is captured, using the function of the calibration section 704. Another arithmetic operation method for calculating a median value, for example, may also be used.

Next, using the calibration section 704, the control section 40 compares the measurement value for the selected display device 10 with the luminance value of the luminance to be displayed (at step S904). The control section 40 judges whether the difference therebetween is equal to or more than a threshold value (at step S905). In the case that the control section 40 judges that the difference is equal to or more than the threshold value (YES at step S905), the control section 40 calculates a correction amount corresponding to the measurement value that is equal to or more than the threshold value (at step S906) and performs the correction of the luminance (at step S907). In the case that the control section 40 judges that the difference in luminance is less than the threshold value (NO at step S905), the control section 40 does not require to correct the luminance for the selected display device 10 and advances the process to the next step S908.

The control section 40 compares the measurement value for the selected display device 10 with the color value of the color to be displayed (at step S908). The control section 40 judges whether the difference therebetween is equal to or more than a threshold value (at step S909). In the case that the control section 40 judges that the difference is equal to or more than the threshold value (YES at step S909), the control section 40 calculates a correction amount corresponding to the measurement value being equal to or more than the threshold value (at step S910) and performs the correction of the color value (at step S911). In the case that the control section 40 judges that the difference in color is less than the threshold value (NO at step S909), the control section 40 advances the process to the next step S912.

It is conceived that various methods may be used for the correction to be performed. A method may be used in which the control section 40 compares the calculated measurement values of the display devices 10 with one another and performs correction in the case that the difference between the maximum measurement value and the minimum measurement value is equal to or more than a predetermined threshold value. Furthermore, as the threshold value of the difference, a value at which the difference is recognized by visual check may be set beforehand, or a configuration may be used in which the threshold value is set beforehand on the basis of the result of a measurement performed using a colorimeter. Using the function of the calibration section 704, the control section 40 corrects, among the measurement values respectively corresponding to the display devices in the multiple display system 10, the luminance values of the image signal to be output to the display devices 10 other than the display device 10 having the lowest luminance value so as to be made coincident with the measurement value corresponding to the display device 10 having the lowest luminance. In other words, the control section 40 performs correction so as to lower the luminance displayed on the other display devices 10. Furthermore, the control section 40 may perform correction so that the image signals to be output to the display devices 10 in which the difference between each measurement value and the luminance value or the color value to be displayed is equal to or more than a predetermined value have the luminance or color to be displayed. In particular, in the case that the display section 1 is formed of a single display device 10, this method is used.

As the correction to be performed at step S907 and at step S911, it may be possible that the control section 40 stores the correction amount of the luminance or color corresponding to each display device 10 as the correction information 712 in the storage section 41 and outputs the correction information 712 as the information of each display device 10 to the signal processing device 2. As a result, the correction is performed by the image processing section 23 of the signal processing device 2 on the basis of the correction information 712.

The control section 40 judges whether the correction process has been performed for all the display devices 10 (at step 912). In the case that the control section 40 judges that the correction process has not been performed (NO at S912), the control section 40 returns the process to step 901, selects the next display device 10 (at step S901) and repeats the following process.

In the case that the control section 40 judges that the correction process has been performed for all the display devices 10 (YES at S912), the control section 40 ends the correction process and returns the process to step S113 of the flow chart shown in FIG. 34. Then, the image signals to be output to the group of the display devices 10 of the display section 1 are corrected.

When the process shown in FIG. 35 is applied to each of the examples shown in FIGS. 30 to 33, the control section 40 first selects the display device 10 located at (0, 0) (at S901), specifies the region A1, the region A2, the region A3, or the region A4 (at S902), and calculates a measurement value corresponding to 255, 170, 85, or 0 from the specified region (at S903). The control section 40 compares the measurement value with 255, 170, 85, or 0 (at S904) and performs correction in the case that the difference is equal to or more than the threshold value. As the method of the correction, after the measurement values of the other display devices 10 are calculated, the luminance value of the output image signal is lowered so as to be made coincident with the measurement value corresponding to the display device 10 having the lowest luminance. Furthermore, the control section 40 selects the respective display devices 10 located at the other positions (0, 1), (1, 0) and (1, 1) (at S901), specifies the regions B1 to B4, the regions C1 to C4, or the regions D1 to D4 (at S902) corresponding to the respective display devices 10, calculates the measurement values (at S903), and then compares and correct the luminance or color.

As described above, correction can be made by using the content to be used to actually perform display on the display section 1 of the display system, by performing calibration while the image based on the content data is displayed, and by specifying a correction amount. The reproduction of the content is not required to be stopped for the calibration. In particular, in a display system for use in digital signage, for example, in which the content is required to be output at all times, the embodiment according to the present invention has an excellent effect in that luminance or color can be calibrated without losing the function of digital signage.

The configurations described in Embodiments 1 to 5 can be combined appropriately and used.

It is construed that the disclosed embodiments according to the present invention are examples in all respects and do not limit the concept of the present invention. The scope of the present invention is defined not by the above descriptions but by the appended claims, and the present invention is intended to include all modifications within the meaning and the range of equivalency of the claims.

What is claimed is:

1. A display system comprising:

a display section configured to display an image on the basis of an image signal which is composed of a plurality of frame images provided continuously in time sequence and is generated from a content data, wherein the image signal is not a predetermined calibration image;

a signal processing section configured to output the image signal to the display section;

a first specifying section configured to specify a frame image from among the plurality of frame images, the specified frame image including a region having predetermined luminance or color at a predetermined ratio or more;

a calibration image producing section configured to produce a calibration image from the specified frame image specified by the first specifying section including a region to be estimated to have uniform luminance or color;

an image signal generating section, from the calibration image produced by the calibration image producing section and the image signal to be output to the display section, configured to generate a new image signal including the calibration image;

a timing specifying section configured to specify a timing at which the calibration image included in the new image signal generated by the image signal generating section is displayed on the display section;

a capturing section configured to capture the calibration image which is displayed on the display section;

a capturing control section configured to cause the capturing section to perform capturing the calibration image at the timing specified by the timing specifying section;

a comparison section configured to compare a luminance or color in the calibration image produced by the calibration image producing section with a luminance or color in the calibration image captured by the capturing section; and a correction information creating section configured to create correction information for correcting an image signal on the basis of the result of the comparison performed by the comparison section.

2. A display system comprising:

a display section configured to display an image on the basis of an image signal which is composed of a plurality of frame images provided continuously in time sequence and is generated from a content data, wherein the image signal is not a predetermined calibration image;

a signal processing section configured to output the image signal to the display section;

a region extracting section configured to extract a region from among the plurality of frame images, the extracted region having uniform luminance or color, for a calibration of luminance or color displayed on the display section;

a timing specifying section configured to specify a timing at which the frame image including the region for a calibration extracted by the region extracting section is displayed on the display section;

a capturing section configured to capture the frame image which is displayed on the display section;

a capturing control section configured to cause the capturing section to perform capturing the frame image including the region for a calibration at the timing specified by the timing specifying section;

a comparison section configured to compare a luminance or color in the region of the frame image extracted by the region extracting section with a luminance or color in the region of the frame image captured by the capturing section, corresponding to the region extracted by the region extracting section; and a correction information creating section configured to create correction information for correcting an image signal on the basis of the result of the comparison performed by the comparison section.

3. The display system according to claim 1, wherein the image signal generating section inserts the calibration image ahead of or behind the specified frame image specified by the first specifying section.

4. The display system according to claim 1, wherein the image signal generating section replaces the specified frame image specified by the first specifying section, a first frame image ahead of the specified frame image, or a second frame image behind the specified frame image with the calibration image.

5. The display system according to claim 1, further comprising:

a second specifying section configured to specify two frame images being different in image features by a predetermined value or more among the plurality of frame images provided continuously in time sequence, wherein the calibration image producing section produces the calibration image on the basis of either one of the two frame images specified by the second specifying section, and the image signal generating section inserts the calibration image produced by the calibration image producing section between the two frame images specified by the second specifying section.

6. The display system according to claim 1, further comprising:

a second specifying section configured to specify two frame images being different in image features by a predetermined value or more among the plurality of frame images provided continuously in time sequence, wherein the calibration image producing section produces the calibration image on the basis of either one of the two frame images specified by the second specifying section, and the image signal generating section replaces either one or both of the two frame images specified by the second specifying section with the calibration image produced by the calibration image producing section.

7. The display system according to claim 1, wherein the image signal generating section generates a new image signal including continuous calibration images having the same luminance or color from the calibration image produced by the calibration image producing section.

8. The display system according to claim 1, further comprising:

a storage section for storing information on calibration images, wherein the calibration image producing section produces calibration images including regions having a luminance or color each for different luminance or color, and the storage section stores information for specifying an order of each calibration image included in the image signal generated by the image signal generating section and information on the luminance or color of the region included in each calibration image.

9. The display system according to claim 1, wherein the display section is formed of a plurality of panels, each displaying an image on the basis of an image signal, the signal processing section divides the image signal of one image into a plurality of image signals so as to correspond to an arrangement of the plurality of panels and outputs the respective divided image signals to the plurality of panels, and the comparison section divides a calibration image captured by the capturing section so as to correspond to the arrangement of the plurality of panels, divides the calibration image so as to correspond to the arrangement of the plurality of panels, and compares each luminance or color of the divided captured calibration images corresponding to the arrangement of the panels with each luminance or color of the divided calibration images also corresponding to the arrangement of the panels.

10. The display system according to claim 2, wherein the display section is formed of a plurality of panels, each displaying an image on the basis of an image signal, the signal processing section divides the image signal of one image into a plurality of image signals so as to correspond to an arrangement of the plurality of panels and outputs the divided respective image signals to the plurality of panels, and the region extracting section extracts regions to be estimated to have uniform luminance or color from part or all of the images using the divided respective image signals.

11. The display system according to claim 2, further comprising:

a storage section for storing information, wherein an image signal to be output sequentially from the signal processing section to the display section is formed of a plurality of frame images provided continuously in time sequence, the region extracting section extracts regions displayed with a luminance or regions including color each for different luminance or color from the plurality of frame images, and the storage section stores first information for specifying the images extracted by the region extracting section, second information for specifying the regions extracted from the images specified by the information, and third information on the luminance or the color of the extracted regions.

12. A non-transitory computer-readable recording medium storing a computer program to cause a computer, connected to a signal processing section configured to output an image signal, which is composed of a plurality of frame images provided continuously in time sequence and is generated from a content data, and wherein the image signal is not a predetermined calibration image to a display section configured to display an image on the basis of the image signal and to a capturing section configured to capture an image displayed on the display section, for controlling the signal processing section and the capturing section, to calibrate a luminance or color in the image displayed on the display section, wherein the computer program comprises the steps of causing the computer to function as a first specifying section configured to specify a frame image from among the plurality of frame images, the specified frame image including a region having predetermined luminance or color at a predetermined ratio or more;

causing the computer to function as a calibration image producing section configured to produce a calibration image from the specified frame image specified by the first specifying section including a region to be estimated to have uniform luminance or color;

causing the computer to function as an image signal generating section, from the calibration image produced by the calibration image producing section and the image signal to be output to the display section, configured to generate a new image signal including the calibration image;

causing the computer to function as a timing specifying section configured to specify a timing at which the calibration image included the new image signal generated by the image signal generating section is displayed on the display section;

causing the computer to function as a capturing control section configured to cause the capturing section to perform capturing the calibration image at the timing specified by the timing specifying section;

causing the computer to function as a comparison section configured to compare a luminance or color in the calibration image produced by the calibration image producing section with a luminance or color in the calibration image captured by the capturing section; and causing the computer to function as a correction information creating section configured to create correction information for correcting an image signal on the basis of the result of the comparison performed by the comparison section.

13. A non-transitory computer-readable recording medium storing a computer program to cause a computer, connected to a signal processing section configured to output an image signal, which is composed of a plurality of frame images provided continuously in time sequence and is generated from a content data, and wherein the image signal is not a predetermined calibration image to a display section configured to display an image on the basis of the image signal and to a capturing section configured to capture an image displayed on the display section, for controlling the signal processing section and the capturing section, to calibrate a luminance or color in the image displayed on the display section, wherein the computer program comprises the steps of:

causing the computer to function as a region extracting section configured to extract a region from among the plurality of frame images, the extracted region having uniform luminance or color, for a calibration of luminance or color displayed on the display section;

causing the computer to function as a timing specifying section configured to specify a timing at which the frame image including the region for a calibration extracted by the region extracting section is displayed on the display section;

causing the computer to function as a capturing control section configured to cause the capturing section to perform capturing the frame image including the region for a calibration at the timing specified by the timing specifying section;

causing the computer to function as a comparison section configured to compare a luminance or color in the region of the frame image extracted by the region extracting section with a luminance or color in the region of the frame image captured by the capturing section, corresponding to the region extracted by the region extracting section; and causing the computer to function as a correction information creating section configured to create correction information for correcting an image signal on the basis of the result of the comparison performed by the comparison section.

* * * * *